US008593076B2

(12) United States Patent
Veskovic

(10) Patent No.: US 8,593,076 B2
(45) Date of Patent: Nov. 26, 2013

(54) ELECTRONIC DIMMING BALLAST HAVING ADVANCED BOOST CONVERTER CONTROL

(75) Inventor: Dragan Veskovic, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 114 days.

(21) Appl. No.: 13/212,773

(22) Filed: Aug. 18, 2011

(65) Prior Publication Data

US 2012/0043899 A1 Feb. 23, 2012

Related U.S. Application Data

(60) Provisional application No. 61/374,809, filed on Aug. 18, 2010.

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 37/02*** | (2006.01) |
| ***H05B 39/04*** | (2006.01) |
| ***H05B 41/36*** | (2006.01) |
| *H05B 41/16* | (2006.01) |
| *H05B 41/24* | (2006.01) |

(52) U.S. Cl.
USPC ..... 315/291; 315/200 R; 315/224; 315/246; 315/247

(58) Field of Classification Search
None
See application file for complete search history.

(56) References Cited

U.S. PATENT DOCUMENTS

| | | | |
|---|---|---|---|
| 5,925,990 | A | 7/1999 | Crouse et al. |
| 6,111,368 | A | 8/2000 | Luchaco |
| 6,452,344 | B1 | 9/2002 | MacAdam et al. |
| 6,642,669 | B1 | 11/2003 | MacAdam et al. |
| 7,075,254 | B2 | 7/2006 | Chitta et al. |
| 7,489,090 | B2 | 2/2009 | Taipale |
| 7,528,554 | B2 | 5/2009 | Chitta et al. |
| 2005/0035729 | A1 | 2/2005 | Lev et al. |
| 2011/0080110 | A1 | 4/2011 | Nuhfer et al. |
| 2011/0080111 | A1 | 4/2011 | Nuhfer et al. |
| 2011/0080112 | A1 | 4/2011 | Shearer et al. |

FOREIGN PATENT DOCUMENTS

JP 2002231483 A * 8/2002

* cited by examiner

*Primary Examiner* — Douglas W Owens
*Assistant Examiner* — Dedei K Hammond
(74) *Attorney, Agent, or Firm* — Mark E. Rose; Philip N. Smith; Bridget L. McDonough

(57) ABSTRACT

An electronic ballast for driving a gas discharge lamp includes a power converter for generating a DC bus voltage, where the bus voltage is controlled to different magnitudes during different operating modes of the ballast. The ballast comprises a control circuit that is coupled to the power converter for adjusting the magnitude of the bus voltage to a first magnitude when the lamp is off, to a second magnitude when preheating filaments of the lamp, and to a third magnitude when the lamp is on. The control circuit is also operable to preemptively adjust the magnitude of the bus voltage prior to changing modes of operation. For example, when turning the load on, the control circuit first adjusts a power-conversion-drive level of the power converter to begin adjusting the magnitude of the bus voltage towards a predetermined magnitude, and then waits for a predetermined time period before attempting to turn the load on.

21 Claims, 15 Drawing Sheets

ELECTRONIC DIMMING BALLAST HAVING ADVANCED BOOST CONVERTER CONTROL

CROSS-REFERENCE TO RELATED APPLICATIONS

This application is a non-provisional application of commonly-assigned U.S. Provisional Application No. 61/374,809, filed Aug. 18, 2010, entitled ELECTRONIC DIMMING BALLAST HAVING ADVANCED BOOST CONVERTER CONTROL, the entire disclosure of which is hereby incorporated by reference.

BACKGROUND OF THE INVENTION

1. Field of the Invention

The present invention relates to a load control device for controlling the amount of power delivered to an electrical load, specifically, to an electronic dimming ballast having advanced control of a power converter.

2. Description of the Related Art

Electronic ballasts for fluorescent lamps typically can be analyzed as comprising a "front-end" and a "back-end". The front-end often includes a rectifier for receiving an alternating-current (AC) mains line voltage and producing a rectified voltage $V_{RECT}$, and a boost converter for receiving the rectified voltage $V_{RECT}$ and generating a direct-current (DC) bus voltage $V_{BUS}$ across a bus capacitor. The boost converter is an active circuit for boosting the magnitude of the DC bus voltage above the peak of the line voltage and for improving the total harmonic distortion (THD) and the power factor of the input current to the ballast. The ballast back-end typically includes a switching inverter circuit for converting the DC bus voltage $V_{BUS}$ to a high-frequency AC square-wave voltage $V_{SQ}$, and a resonant tank circuit for generating a sinusoidal voltage $V_{SIN}$ from the square-wave voltage $V_{SQ}$ and coupling the sinusoidal voltage $V_{SIN}$ to the lamp electrodes of the fluorescent lamp. The amount of power delivered to the lamp may be adjusted by controlling a duty cycle $DC_{SQ}$ of the square-wave voltage $V_{SQ}$ to thus control the intensity of the lamp from a low-end intensity $L_{LE}$ to a high-end intensity $L_{HE}$.

The boost converters of most prior art ballasts have controlled the magnitude of the bus voltage $V_{BUS}$ to a constant magnitude independent of the operating conditions of the ballast. Some prior art ballasts have been operable to turn off the boost converter (such that the magnitude of the DC bus voltage equals approximately the peak magnitude of the line voltage) when the intensity of the lamp is near the low-end intensity $L_{LE}$, as described in commonly-assigned U.S. Pat. No. 7,075,254, issued Jul. 11, 2006, entitled LIGHTING BALLAST HAVING BOOST CONVERTER WITH ON/OFF CONTROL AND METHOD OF BALLAST OPERATION, the entire disclosure of which is hereby incorporated by reference. However, the prior art ballast of U.S. Pat. No. 7,075,254 was only able to control the boost converter to two discrete states (i.e., on and off).

Thus, there is a need for an electronic dimming ballast that is able to control the magnitude of the bus voltage $V_{BUS}$ according to a more advanced control scheme during the different modes of operation of the ballast.

SUMMARY OF THE INVENTION

According to an embodiment of the present invention, an electronic ballast for driving a gas discharge lamp comprises a power converter for generating a DC bus voltage, where the bus voltage is controlled to different magnitudes during different operating modes of the ballast. The ballast further comprises an inverter circuit for converting the bus voltage to a high-frequency AC voltage, a resonant tank operable to couple the high-frequency AC voltage to the lamp to generate a load current through the lamp, a control circuit coupled to the inverter circuit for controlling the magnitude of the load current through the lamp. The control circuit further coupled to the power converter for adjusting the magnitude of the bus voltage to a first magnitude when the lamp is off, to a second magnitude when preheating filaments of the lamp, and to a third magnitude when the lamp is on.

According to another embodiment of the present invention, an electronic ballast for driving a gas discharge lamp comprises: (1) a power converter for generating a DC bus voltage; (2) an inverter circuit for converting the bus voltage to a high-frequency AC voltage having an operating frequency and an operating duty cycle; (3) a resonant tank operable to couple the high-frequency AC voltage to the lamp to generate a load current through the lamp; and (4) a control circuit coupled to the inverter circuit for controlling the magnitude of the load current through the lamp and to the power converter for adjusting the magnitude of the bus voltage. Prior to preheating filaments of the lamp, the control circuit controls a power-conversion-drive level of the power converter to begin adjusting the magnitude of the bus voltage towards a first predetermined magnitude, and waits for a first predetermined time period after controlling the power-conversion-drive level before adjusting the operating frequency of the inverter circuit to a preheat frequency Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which:

FIG. 10 is a simplified flowchart of a lamp strike routine that is executed by the microprocessor of the ballast of FIG. 1 when the ballast receives a command to turn the lamp on;

DETAILED DESCRIPTION OF THE INVENTION

Figure 1:
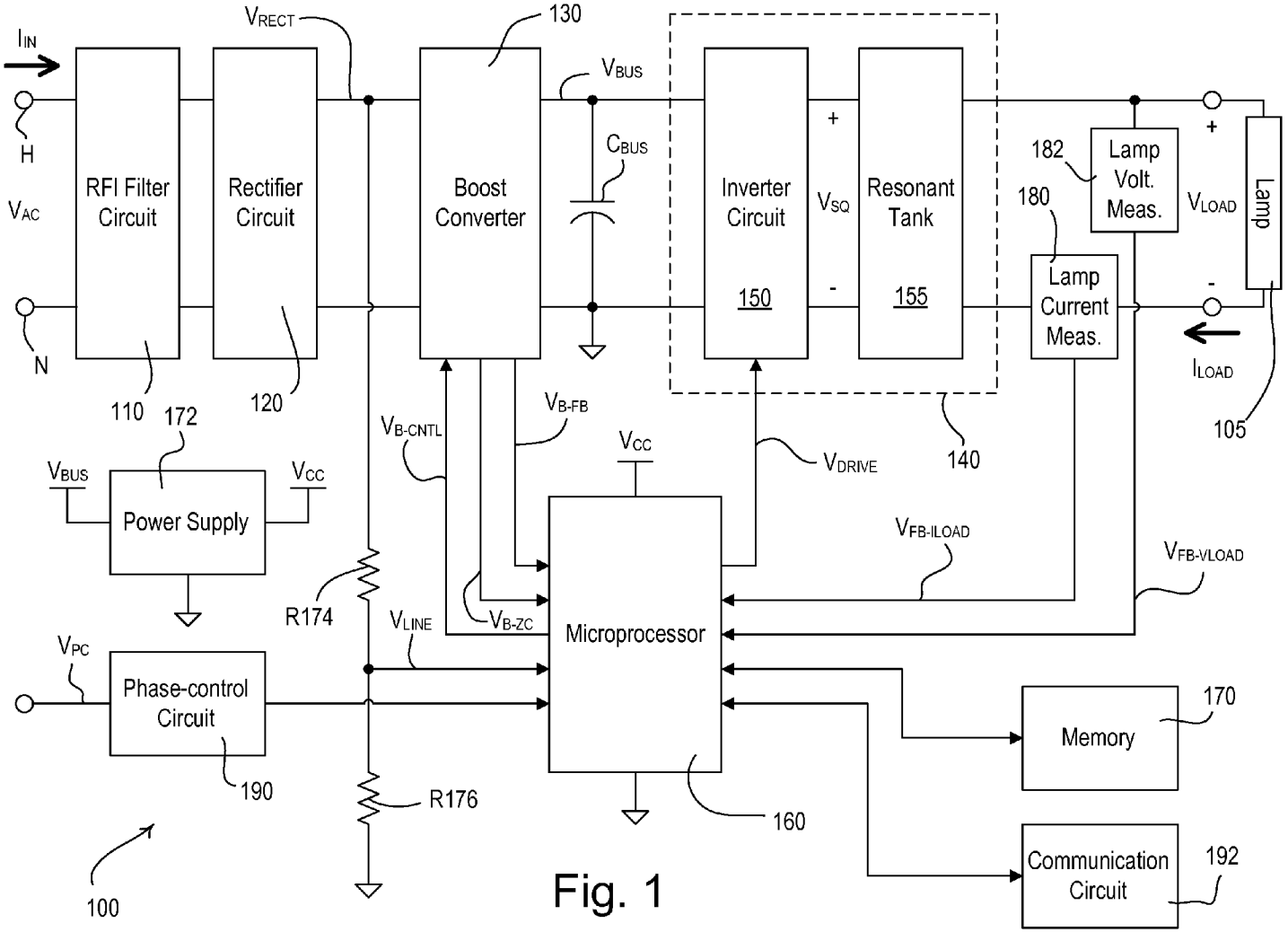
FIG. 1 is a simplified block diagram of an electronic dimming ballast for driving a gas discharge lamp according to a first embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of a load control device, e.g., an electronic dimming ballast 100, according to a first embodiment of the present invention. The ballast 100 comprises a hot terminal H and a neutral terminal N that are adapted to be coupled to an alternating-current (AC) power source (not shown) for receiving an AC mains line voltage $V_{AC}$ (e.g. 120 VAC @60 Hz). Alternatively, the AC mains line voltage $V_{AC}$ could have a magnitude of 240 VAC or 277 VAC. The ballast 100 is adapted to be coupled between the AC power source and a lighting load, such as a gas discharge lamp (e.g., a fluorescent lamp 105), such that the ballast is operable to control the amount of power delivered to the lamp and thus the intensity of the lamp. While only one lamp 105 is shown in FIG. 1, the ballast 100 may be operable to control the intensities of multiple lamps coupled in series or in parallel with the output of the ballast. The ballast 100 comprises an RFI (radio frequency interference) filter circuit 110 for minimizing the noise provided on the AC mains, and a rectifier circuit 120 for generating a rectified voltage $V_{RECT}$ from the AC mains line voltage $V_{AC}$.

The ballast 100 further comprises a power converter, e.g., a boost converter 130, which generates a direct-current (DC) bus voltage $V_{BUS}$ across a bus capacitor $C_{BUS}$. The bus voltage $V_{BUS}$ has, for example, a magnitude (e.g., 465 volts) that is greater than the peak magnitude $V_{PK}$ of the AC mains line voltage $V_{AC}$ (e.g., approximately 170 volts when the AC mains line voltage $V_{AC}$ has a magnitude of 120 VAC). The boost converter 130 also operates as a power-factor correction (PFC) circuit for improving the power factor of the ballast 100. Alternatively, the power converter of the ballast 100 could comprise, for example, a buck converter, a buck-boost converter, a flyback converter, a buck-boost flyback converter, a single-ended primary-inductor converter (SEPIC), a Ćuk converter, or other suitable power converter circuit.

The ballast 100 further comprises a load control circuit 140 for controlling the amount of power delivered to the lamp 105. According to the first embodiment of the present invention, the load control circuit 140 comprises a ballast circuit including an inverter circuit 150 for converting the DC bus voltage $V_{BUS}$ to a high-frequency AC voltage (e.g., a square-wave voltage $V_{SQ}$), and a resonant tank circuit 155 for coupling the high-frequency AC voltage generated by the inverter circuit to filaments of the lamp 105. The resonant tank circuit 155 may comprise a resonant inductor (not shown) and a resonant capacitor (not shown), which are characterized by a resonant frequency $f_{RES}$. The resonant inductor is adapted to be coupled in series between the inverter circuit 150 and the lamp 105, while the resonant capacitor is adapted to be coupled in parallel with the lamp or lamps.

Prior to striking the lamp 105, the filaments of the lamp must be heated during a preheat mode to extend lamp life. Accordingly, the resonant tank circuit 155 comprises a plurality of filament windings (not shown) that are magnetically coupled to the resonant inductor for generating filament voltages for heating the filaments of the lamp 105 during the preheat mode. An example of a ballast having a circuit for heating the filaments of a fluorescent lamp is described in greater detail in U.S. Pat. No. 7,586,268, issued Sep. 8, 2009, titled APPARATUS AND METHOD FOR CONTROLLING THE FILAMENT VOLTAGE IN AN ELECTRONIC DIMMING BALLAST, the entire disclosure of which is hereby incorporated by reference.

The ballast 100 further comprises a control circuit, e.g., a microprocessor 160, for controlling the intensity of the lamp 105 to a target intensity $L_{TARGET}$ between a low-end (i.e., minimum) intensity $L_{LE}$ (e.g., approximately 1%) and a high-end (i.e., maximum) intensity $L_{HE}$ (e.g., approximately 100%). The microprocessor 160 may alternatively be implemented as a microcontroller, a programmable logic device (PLD), an application specific integrated circuit (ASIC), or any suitable type of controller or control circuit. The ballast 100 also comprises a memory 170, which is coupled to the microprocessor 160 for storing the target intensity $L_{TARGET}$ and other operational characteristics of the ballast. The memory 170 may be implemented as an external integrated circuit (IC) or as an internal circuit of the microprocessor 160. A power supply 172 receives the bus voltage $V_{BUS}$ and generates a DC supply voltage $V_{CC}$ (e.g., approximately five volts) for powering the microprocessor 160 and other low-voltage circuitry of the ballast 100. The ballast 100 further comprises a resistive divider including two resistors R174, R176, which are coupled in series between the rectified voltage $V_{RECT}$ and circuit common and may have, for example, resistances of approximately 996 kΩ and 6.49 kΩ, respectively. A line voltage sensing signal $V_{LINE}$ is generated at the junction of the two resistors R174, R176 and is representative of the magnitude of the rectified voltage $V_{RECT}$. The line voltage sensing signal $V_{LINE}$ is provided to the microprocessor 160, such that the microprocessor is operable to determine the magnitude of rectified voltage $V_{RECT}$ and the AC mains line voltage $V_{AC}$ from the magnitude of the line voltage sensing signal $V_{LINE}$.

The microprocessor 160 is coupled to the inverter circuit 150 and provides a drive control signal $V_{DRIVE}$ to the inverter circuit for controlling the magnitude of a load voltage $V_{LOAD}$ generated across the lamp 105 and the magnitude of a load current $I_{LOAD}$ conducted through the lamp. The microprocessor 160 may control one or both of two operational parameters of the inverter circuit 150 (e.g., an operating frequency $f_{OP}$ and an operating duty cycle $DC_{OP}$) to thus control the magnitudes of the load voltage $V_{LOAD}$ and the load current $I_{LOAD}$. The microprocessor 160 controls the inverter circuit 150 to illuminate the lamp 105 during an on mode, and extinguishes the lamp 105 during an off mode. In addition, the microprocessor 160 is operable to control the inverter circuit 150 so as to adjust (i.e., dim) the intensity of the lamp 105 during the on mode. The microprocessor 160 receives a load current feedback signal $V_{FB-LOAD}$, which is generated by a load current measurement circuit 180 and is representative of the magnitude of the load current $I_{LOAD}$. The microprocessor 160 also receives a load voltage feedback signal $V_{FB-VLOAD}$, which is generated by a load voltage measurement circuit 182 and is representative of the magnitude of the load voltage $V_{LOAD}$.

The microprocessor 160 is further coupled to the boost converter 130 for controlling the magnitude of the bus voltage $V_{BUS}$ to a target bus voltage $V_{B-TARGET}$. Specifically, the microprocessor 160 provides a bus voltage control signal $V_{B-CNTL}$ to the boost converter 130 for adjusting the magnitude of the bus voltage $V_{BUS}$ in response to a bus voltage feedback signal $V_{B-FB}$ and a zero-current feedback signal $V_{B-ZC}$ as will be described in greater detail below. According to an embodiment of the present invention, the microprocessor 160 is operable to adjust the bus voltage $V_{BUS}$ to different magnitudes during different operating modes of the ballast 100 (i.e., the off mode, the preheat mode, and the on mode).

The ballast 100 may comprise a phase-control circuit 190 for receiving a phase-control voltage $V_{PC}$ (e.g., a forward or reverse phase-control signal) from a standard phase-control dimmer (not shown). The microprocessor 160 is coupled to the phase-control circuit 190, such that the microprocessor is operable to determine the target intensity $L_{TARGET}$ for the lamp 105 from the phase-control voltage $V_{PC}$. The ballast 100 may also comprise a communication circuit 192, which is coupled to the microprocessor 160 and allows the ballast to communicate (i.e., transmit and receive digital messages) with the other control devices on a communication link (not shown), e.g., a wired communication link or a wireless communication link, such as a radio-frequency (RF) or an infrared (IR) communication link. Examples of ballasts having communication circuits are described in greater detail in commonly-assigned U.S. Pat. No. 7,489,090, issued Feb. 10, 2009, entitled ELECTRONIC BALLAST HAVING ADAPTIVE FREQUENCY SHIFTING; U.S. Pat. No. 7,528,554, issued May 5, 2009, entitled ELECTRONIC BALLAST HAVING A BOOST CONVERTER WITH AN IMPROVED RANGE OF OUTPUT POWER; and U.S. Pat. No. 7,764,479, issued Jul. 27, 2010, entitled COMMUNICATION CIRCUIT FOR A DIGITAL ELECTRONIC DIMMING BALLAST, the entire disclosures of which are hereby incorporated by reference.

Figure 2:
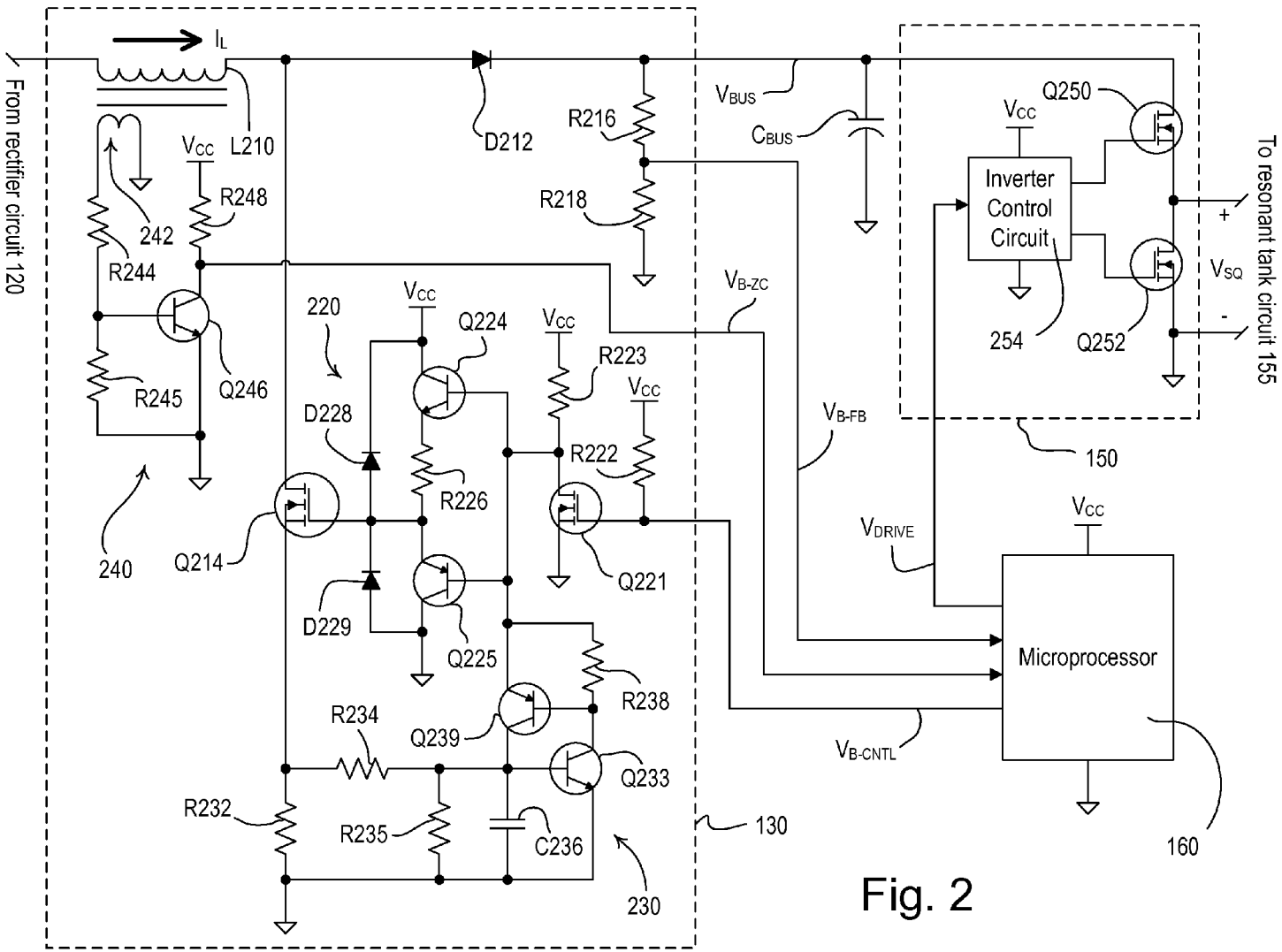
FIG. 2 is a simplified schematic diagram of a boost convert and an inverter circuit of the ballast of FIG. 1.

FIG. 2 is a simplified schematic diagram of the boost converter 130 and the inverter circuit 150. The inverter circuit 150 comprises first and second series-connected switching devices (e.g., FETs Q250, Q252) and an inverter control circuit 254, which controls the FETs in response to the drive control signal $V_{DRIVE}$ from the microprocessor 160. The inverter control circuit 254 may comprise, for example, an integrated circuit (IC), such as part number NCP5111, manufactured by On Semiconductor. The inverter control circuit 254 may control the FETs Q250, Q252 using a "d(1-d)" complementary switching scheme, in which the first FET Q250 has a duty cycle of d (i.e., equal to the operating duty cycle $DC_{OP}$) and the second FET Q252 has a duty cycle of 1-d, such that only one FET is conducting at a time. When the first FET Q250 is conductive, the output of the inverter circuit 150 is pulled up towards the bus voltage $V_{BUS}$. When the second FET Q252 is conductive, the output of the inverter circuit 150 is pulled down towards circuit common. The magnitude of the load current $I_{LOAD}$ conducted through the lamp 105 is controlled by adjusting the operating frequency $f_{OP}$ and/or the duty cycle $DC_{OP}$ of the high-frequency square-wave voltage $V_{SQ}$ generated by the inverter circuit 150.

The boost converter 130 comprises an inductor L210, which receives the rectified voltage $V_{RECT}$ from the rectifier circuit 120, conducts an inductor current $I_L$, and has an inductance $L_{210}$ of, for example, approximately 0.81 mH. The inductor L210 is coupled to the bus capacitor $C_{BUS}$ via a diode D212. A power switching device, e.g., a field-effect transistor (FET) Q214 is coupled in series electrical connection between the junction of the inductor L210 and the diode D212 and circuit common, and is controlled to be conductive and non-conductive, so as to generate the bus voltage $V_{BUS}$ across the bus capacitor $C_{BUS}$. The FET Q214 could alternatively be implemented with a bipolar junction transistor (BJT), an insulated-gate bipolar transistor (IGBT), or any suitable transistor. A resistor divider is coupled across the bus capacitor $C_{BUS}$ and comprises two resistors R216, R218, which have, for example, resistances of approximately 1392 kΩ and 10 kΩ, respectively. The bus voltage feedback signal $V_{B-FB}$ is generated at the junction of the resistor R216, R218, such that the magnitude of the bus voltage feedback signal $V_{B-FB}$ is representative of the magnitude of the bus voltage $V_{BUS}$.

As shown in FIG. 2, the microprocessor 160 is operatively coupled to the FET Q214 of the boost converter 130 for directly controlling the FET Q214 to be conductive and non-conductive to selectively charge and discharge the inductor L210 and generate the bus voltage $V_{BUS}$ across the bus capacitor $C_{BUS}$. The boost converter 130 comprises a drive circuit 220, which is coupled to a gate of the FET Q214 for rendering the FET conductive and non-conductive in response to the bus voltage control signal $V_{B-CNTL}$ from the microprocessor 160. The microprocessor 160 controls the bus voltage control signal $V_{B-CNTL}$ to adjust a power-conversion-drive level of the FET Q214 for controlling how long the FET Q214 is rendered conductive and thus the magnitude of the bus voltage $V_{BUS}$.

The drive circuit 220 comprises FET Q221 having a gate that receives the bus voltage control signal $V_{B-CNTL}$ from the microprocessor 160 and is coupled to the DC supply voltage $V_{CC}$ through a resistor R222 (e.g., having a resistance of approximately 10 kΩ). The drain of the FET Q221 is also coupled to the DC supply voltage $V_{CC}$ through a resistor R223, which has, for example, a resistance of approximately 6.04 kΩ. The junction of the FET Q221 and the resistor R223 is coupled to the bases of an NPN bipolar junction transistor Q224 and a PNP bipolar junction transistor R225. The emitters of the transistor Q224, Q225 are coupled together through a resistor R226 (e.g., having a resistance of approximately 100Ω). The junction of the emitter of the transistor Q225 and the resistor R226 is coupled to the gate of the FET Q214. A diode D228 is coupled between the gate of the FET Q214 and the DC supply voltage $V_{CC}$, while a diode D229 is coupled between circuit common and the gate of the FET Q214. When the bus voltage control signal $V_{B-CNTL}$ is driven high towards the DC supply voltage $V_{CC}$, the FET Q221 and thus the transistor Q225 are rendered conductive, thus pulling the gate of the FET Q214 down towards circuit common, such that the FET Q214 is rendered non-conductive. When the bus voltage control signal $V_{B-CNTL}$ is driven low towards circuit common, the FET Q221 is rendered non-conductive, and the transistor Q224 pulls the gate of the FET Q214 up towards the DC supply voltage $V_{CC}$, thus rendering the FET Q214 conductive.

The boost converter 130 also comprises an over-current protection circuit 230, which operates to render the FET Q214 non-conductive in the event of an over-current condition in the FET. The over-current protection circuit 230 comprises a sense resistor R232 that is coupled in series with the FET Q214 and has a resistance of, for example, approximately 0.075Ω. The voltage generated across the sense resistor R232 is coupled to the base of an NPN bipolar junction transistor Q233 via a resistor R234 (e.g., having a resistance of approximately 392 kΩ). The base of the transistor Q233 is also coupled to circuit common through a resistor R235 (e.g., having a resistance of approximately 4.02 kΩ) and a capacitor C236 (e.g., having a capacitance of approximately 1000 pF). The collector of the transistor Q233 is coupled to the junction of the transistor Q224, 225 of the drive circuit 220 through a resistor R238 (e.g., having a resistance of approximately 22.1 kΩ). The junction of the transistor Q233 and the resistor R238 is coupled to the base of a PNP bipolar junction transistor Q239. When the voltage across the sense resistor R232 exceeds a predetermined over-current threshold voltage (i.e., as a result of an over-current condition in the FET Q214, e.g., approximately 10 amps), the transistor Q233 is rendered conductive, thus pulling the bases of the transistors Q224, Q225 down towards circuit common and rendering the FET Q214 non-conductive. At this time, the transistor Q239 is also rendered conductive, thus latching the transistor Q233 in the conductive state until the present drive pulse ends (i.e., the gate of the FET Q214 is driven low).

The boost converter 130 further comprises a zero-current detect circuit 240, which generates the zero-current feedback signal $V_{B\text{-}ZC}$ when the magnitude of the voltage induced by the inductor L210 collapses to approximately zero volts to indicate when the magnitude of the inductor current $I_L$ conducted by the inductor is approximately zero amps. The zero-current detect circuit 240 comprises a control winding 242 that is magnetically coupled to the inductor L210. The control winding 242 is coupled in series with two resistors R244, R245, which each have, for example, resistances of approximately 22 kΩ. The junction of the resistor R244, R245, is coupled to the base of an NPN bipolar junction transistor Q246. The collector of the transistor Q246 is coupled to the DC supply voltage $V_{CC}$ through a resistor R248 (e.g., having a resistance of approximately 2.15 kΩ), such that the zero-current feedback signal $V_{B\text{-}ZC}$ is generated at the collector of the transistor. When the voltage across the inductor L210 is greater than approximately zero volts, a voltage is produced across the control winding 242 and the transistor Q246 is rendered conductive, thus driving the zero-current feedback signal $V_{B\text{-}ZC}$ down towards circuit common. When the magnitude of the inductor current $I_L$ drops to approximately zero amps, the transistor Q246 is rendered non-conductive and the zero-current feedback signal $V_{B\text{-}ZC}$ is pulled up towards the DC supply voltage $V_{CC}$.

Figure 3:
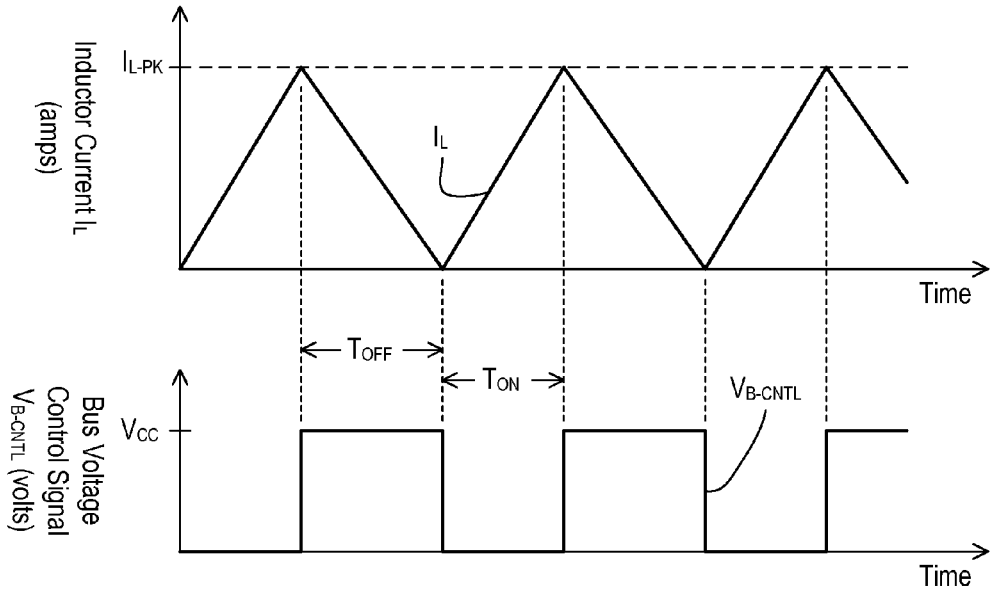
FIG. 3 shows example timing diagrams of an inductor current and a bus voltage control signal of the boost converter of FIG. 2 when the boost converter is operating in critical conduction mode.
Figure 4:
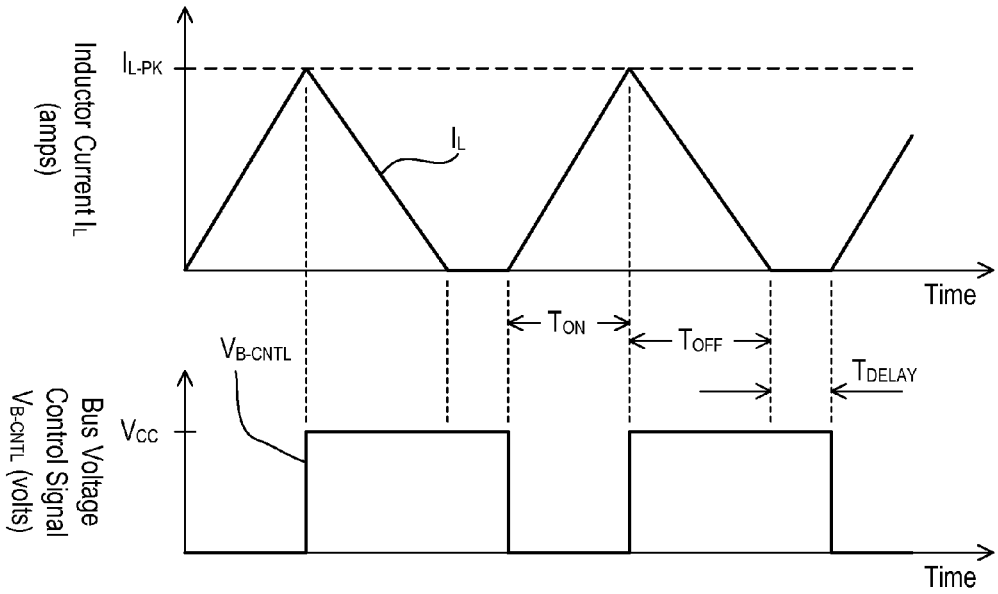
FIG. 4 shows example timing diagrams of the inductor current and the bus voltage control signal of the boost converter of FIG. 2 when the boost converter is operating in discontinuous conduction mode.

The microprocessor 160 controls the FET Q214 to selectively operate the boost converter 130 in critical conduction and discontinuous conduction modes. FIG. 3 shows example timing diagrams of the inductor current $I_L$ and the bus voltage control signal $V_{B\text{-}CNTL}$ when the boost converter 130 is operating in the critical conduction mode. In critical conduction mode, the FET Q214 is controlled to be conductive when the inductor current $I_L$ drops to zero amps. The FET Q214 is maintained conductive for an on time $T_{ON}$, such that the inductor current $I_L$ increases in magnitude with respect to time during the on time $T_{ON}$ and rises to a peak inductor current $I_{L\text{-}PK}$. The FET Q214 is then controlled to be non-conductive for an off time $T_{OFF}$, such that the inductor current $I_L$ decreases in magnitude with respect to time until the magnitude of the inductor current $I_L$ reaches zero amps, at which time the FET Q214 is once again rendered conductive. FIG. 4 shows example timing diagrams of the inductor current $I_L$ and the bus voltage control signal $V_{B\text{-}CNTL}$ when the boost converter 130 is operating in the discontinuous conduction mode. In the discontinuous mode, the FET Q214 is controlled to be conductive for the on time $T_{ON}$ and to be non-conductive for the off time $T_{OFF}$. However, when the inductor current $I_L$ drops to approximately zero amps, the FET Q214 is maintained non-conductive for a delay time $T_{DELAY}$, such that the inductor current $I_L$ does not begin to increase in magnitude, but remains at approximately zero amps. While not shown in FIG. 3, there may be some oscillations in the inductor current $I_L$ during the delay time $T_{DELAY}$ after the FET Q214 is rendered non-conductive.

The microprocessor 160 is operable to adjust the length of the on time $T_{ON}$ in response to the magnitude of the bus voltage $V_{BUS}$ (i.e., as determined from the bus voltage feedback signal $V_{B\text{-}FB}$) to thus adjust the magnitude of the bus voltage. Specifically, the microprocessor 160 is operable to increase the on time $T_{ON}$ to increase the magnitude of the bus voltage $V_{BUS}$ and to decrease the on time $T_{ON}$ to decrease the magnitude of the bus voltage $V_{BUS}$. The microprocessor 160 does not control the on time $T_{ON}$ to be greater than a maximum on time $T_{ON\text{-}MAX}$ (e.g., approximately 23 microseconds).

Figure 5:
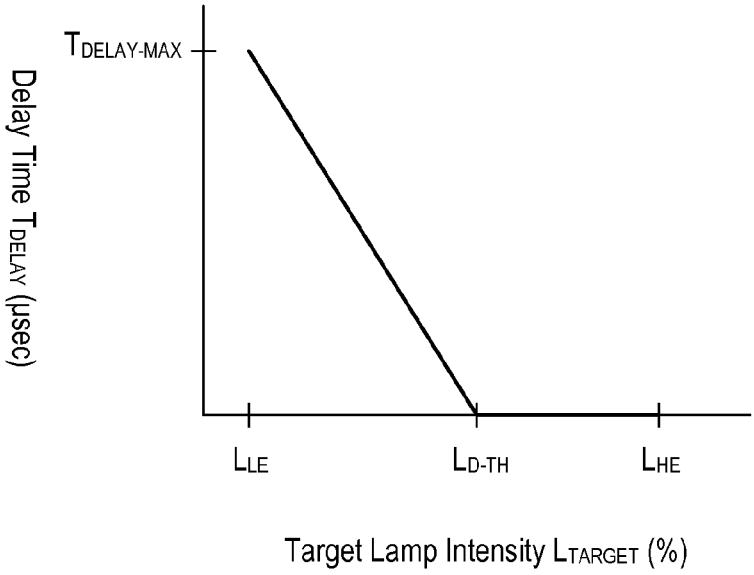
FIG. 5 is an example plot a delay time of the boost converter of FIG. 2 with respect to a target intensity of the lamp.

The microprocessor 160 is operable to control the delay time $T_{DELAY}$ in response to the target intensity $L_{TARGET}$ of the lamp 105. FIG. 5 is an example plot of the length of the delay time $T_{DELAY}$ with respect to the target intensity $L_{TARGET}$ of the lamp 105. Above a delay time threshold intensity $L_{D\text{-}TH}$ (e.g., approximately 60%), the microprocessor 160 controls the delay time $T_{DELAY}$ to be approximately zero seconds. When the target intensity $L_{TARGET}$ of the lamp 105 is greater than the delay time threshold intensity $L_{D\text{-}TH}$, the microprocessor 160 adjusts the delay time $T_{DELAY}$ linearly with respect to the target intensity $L_{TARGET}$ as shown in FIG. 5. Alternatively, the microprocessor 160 may be operable to control the delay time $T_{DELAY}$ in response to the magnitude of the bus voltage $V_{BUS}$.

Figure 6:
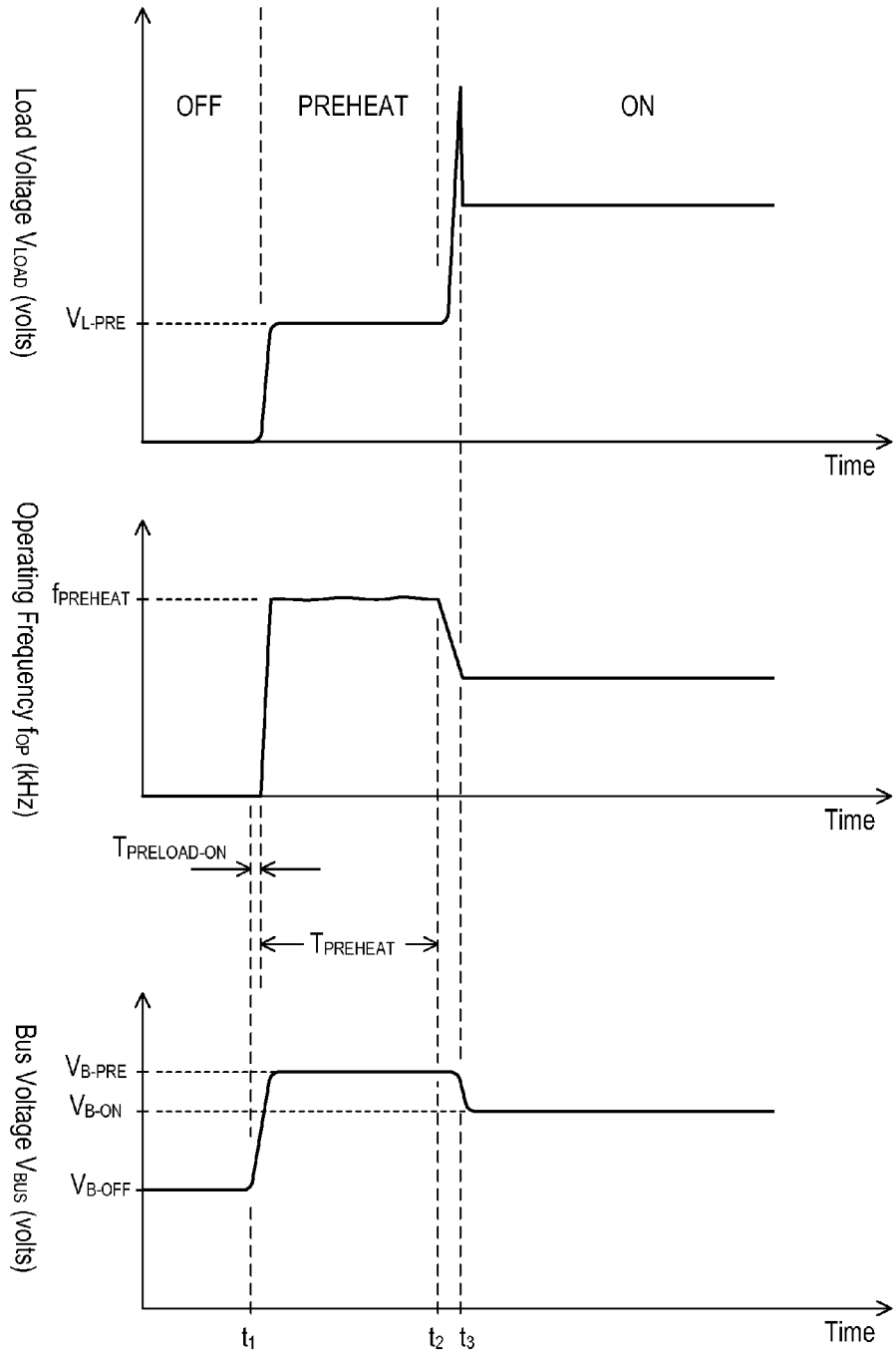
FIG. 6 shows example timing diagrams of the magnitude of a load voltage, an operating frequency, and a bus voltage of the ballast of FIG. 1 while striking the lamp.

As previously mentioned, the microprocessor 160 is operable to adjust the bus voltage $V_{BUS}$ to different magnitudes during different operating modes of the ballast 100 (e.g., the off mode, the preheat mode, and the on mode). FIG. 6 shows example timing diagrams of the magnitude of the load voltage $V_{LOAD}$, the operating frequency $f_{OP}$, and the bus voltage $V_{BUS}$ while the microprocessor 160 is striking the lamp 105. When the lamp 105 is off (i.e., in the off mode), the microprocessor 160 controls the boost converter 130 to maintain the bus voltage $V_{BUS}$ at an off-bus-voltage magnitude $V_{B\text{-}OFF}$, which is greater than zero volts and may be, for example, equal to approximately 205 volts when the AC mains line voltage $V_{AC}$ has a nominal magnitude of 120 VAC. Since the boost converter 130 is not off, but is generating the bus voltage $V_{BUS}$, during the off mode, the ballast 100 is able to quickly illuminate (i.e., strike) the lamp 105. Alternatively, the off-bus-voltage magnitude $V_{B\text{-}OFF}$ may be equal to approximately 430 volts when the AC mains line voltage $V_{AC}$ has a magnitude of 277 VAC. In addition, the boost converter 130 could be turned off when the lamp 105 is off, such that the magnitude of the bus voltage $V_{BUS}$ is equal to approximately the peak magnitude $V_{PK}$ of the AC mains line voltage $V_{AC}$ (i.e., approximately 170 volts when the AC mains line voltage $V_{AC}$ has a magnitude of 120 VAC), and the ballast 100 consumes even less power.

After receiving a command to strike the lamp 105 (i.e., at time $t_1$ in FIG. 6), the microprocessor 160 first preheats the filaments of the lamp 105 for a preheat time period $T_{PREHEAT}$ (e.g., approximately one second) during the preheat mode. Specifically, the microprocessor 160 controls the operating frequency $f_{OP}$ of the inverter circuit 150 to adjust the load voltage $V_{LOAD}$ to a predetermined preheat load voltage $V_{L\text{-}PRE}$, such that the operating frequency $f_{OP}$ is approximately equal to a preheat frequency $f_{PREHEAT}$, e.g., approximately 130 kHz, during the preheat mode. In addition, the microprocessor 160 controls the bus voltage $V_{BUS}$ to a preheat-bus-voltage magnitude $V_{B\text{-}PRE}$ during the preheat mode. The preheat-bus-voltage magnitude $V_{B\text{-}PRE}$ is greater than the off-bus-voltage magnitude $V_{B\text{-}OFF}$, and may be, for example, approximately 500 volts, such that the magnitude of the bus voltage $V_{BUS}$ provided to the resonant tank circuit 155 is great enough to appropriately heat the filaments of the lamp 105 during the preheat mode, but does not exceed the rated voltage of the bus capacitor $C_{BUS}$. Specifically, when the magnitude of the bus voltage $V_{BUS}$ is at the preheat-bus-voltage magnitude $V_{B\text{-}PRE}$, the ratio of the voltage across the resonant inductor of the resonant tank circuit 155 with respect to the voltage across the resonant capacitor increases, such that the ratio of the magnitudes of the filament voltages with respect to the magnitude of the load voltage $V_{LOAD}$ generated across the lamp 105) also increases. Since there is a relatively low voltage across the lamp 105 as compared to the filament voltages, the lamp does not glow or strike during the preheat time period $T_{PREHEAT}$.

After preheating the filaments of the lamp 105 (i.e., after the preheat time period $T_{PREHEAT}$ at time $t_2$ in FIG. 6), the microprocessor 160 sweeps the operating frequency $f_{OP}$ of the inverter circuit 150 down from the preheat frequency $f_{PRE}$ towards the resonant frequency $f_{RES}$ of the resonant tank circuit 155, such that the magnitude of the load voltage $V_{LOAD}$ increases until the lamp 105 strikes (i.e., at time $t_3$ in FIG. 6). When the lamp 105 strikes, the magnitude of the load voltage $V_{LOAD}$ decreases and the magnitude of the load current $I_{LOAD}$ increases, such that the microprocessor 160 is able to detect the lamp strike in response to the load voltage feedback signal $V_{FB\text{-}LOAD}$ and the load current feedback signal $V_{FB\text{-}ILOAD}$. While the lamp 105 is illuminated (i.e., in the on mode), the microprocessor 160 adjusts the magnitude of the bus voltage $V_{BUS}$ to an on-bus-voltage magnitude $V_{ON\text{-}BUS}$, for example, approximately 465 volts, which is less than the preheat-bus-voltage magnitude $V_{B\text{-}PRE}$, but greater than the off-bus-voltage magnitude $V_{B\text{-}OFF}$. In other words, the magnitude of the bus voltage $V_{BUS}$ is largest during the preheat mode, and smallest when the lamp 105 is off, such that the ballast 100 consumes less power.

In addition, the microprocessor 160 is operable to preemptively adjust the power-conversion-drive level of the FET Q214 to begin adjusting the magnitude of the bus voltage $V_{BUS}$ prior to changing modes of operation. When attempting to strike the lamp 105, the microprocessor 160 is operable to control the boost converter 130 (i.e., at time $t_1$ in FIG. 6) to begin increasing the magnitude of the bus voltage $V_{BUS}$ from the off-bus-voltage magnitude $V_{B\text{-}OFF}$ to the preheat-bus-voltage magnitude $V_{B\text{-}PRE}$ prior to controlling the inverter circuit 150 to adjust the operating frequency $f_{OP}$ to the preheat frequency $f_{PRE}$. For example, the microprocessor 160 monitors the magnitude of the bus voltage $V_{BUS}$ after adjusting the power-conversion-drive level of the FET Q214, and may control the inverter circuit 150 to begin preheating the filaments of the lamp 105 when the magnitude of the bus voltage $V_{BUS}$ is equal to approximately the preheat-bus-voltage magnitude $V_{B\text{-}PRE}$, such that a predetermined turn-on preload time period $T_{PRELOAD\text{-}ON}$ exists between when the microprocessor 160 adjusts the power-conversion-drive level of the FET Q214 and when the microprocessor adjusts the operating frequency $f_{OP}$ to the preheat frequency $f_{PRE}$ (as shown in FIG. 6). Accordingly, the length of the turn-on preload time period $T_{PRELOAD\text{-}ON}$ may not be the same each time that the lamp is turned on. Alternatively, the microprocessor 160 may wait for a predetermined turn-on preload time period $T_{PRELOAD\text{-}ON}$ (e.g., approximately 50 milliseconds) after adjusting the target bus voltage $V_{B\text{-}TARGET}$ before adjusting the operating frequency $f_{OP}$.

The microprocessor 160 may also be operable to calculate an average input power $P_{IN\text{-}AVE}$ of the ballast 100 using the inductance of the inductor $L_{210}$, the magnitudes of the bus voltage $V_{BUS}$ and the rectified voltage $V_{RECT}$, and the lengths of the on time $T_{ON}$ and the delay time $T_{DELAY}$ as described in greater detail in commonly-assigned U.S. patent application Ser. No. 13/212,556, filed Aug. 18, 2011, entitled METHOD AND APPARATUS FOR MEASURING OPERATING CHARACTERISTICS IN A LOAD CONTROL DEVICE, the entire disclosure of which is hereby incorporated by reference.

Figure 7:
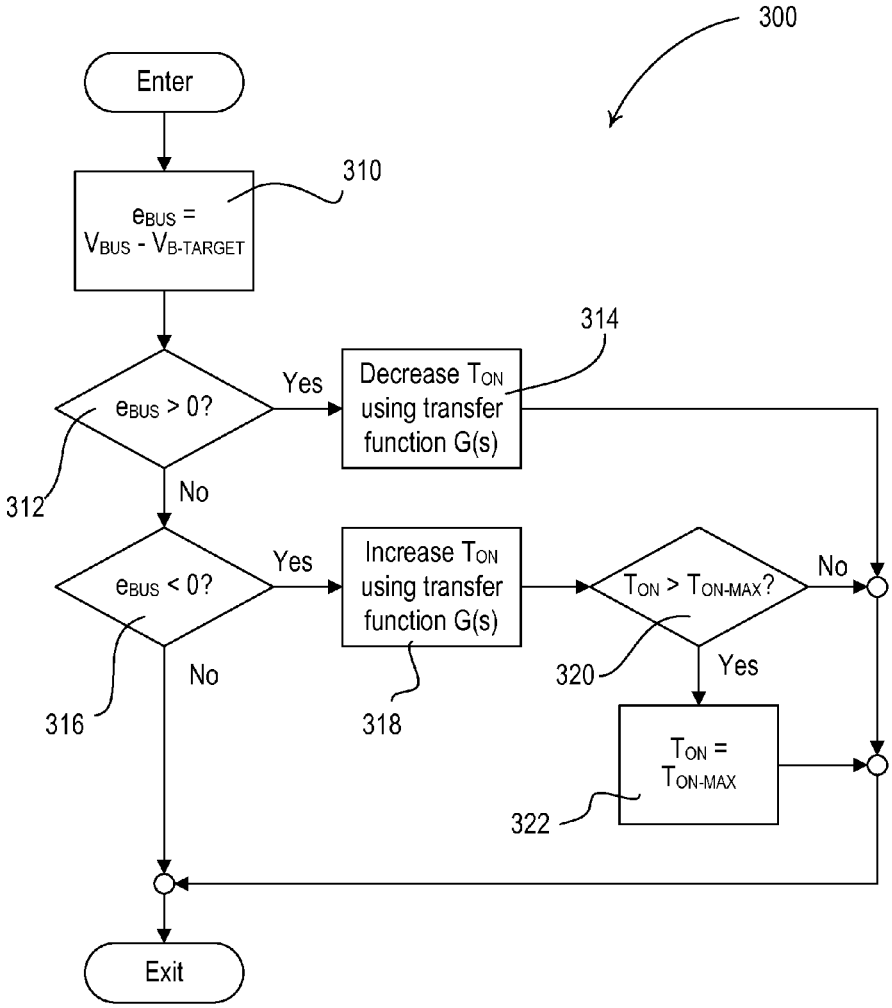
FIG. 7 is a simplified flowchart of a bus voltage control procedure executed periodically by a microprocessor of the ballast of FIG. 1.

FIG. 7 is a simplified flowchart of a bus voltage control procedure 300 executed periodically by the microprocessor 160 (e.g., approximately every 104 microseconds). The microprocessor 160 first calculate a bus voltage error $e_{BUS}$ at step 310 by subtracting the target bus voltage $V_{B\text{-}TARGET}$ from the bus voltage $V_{BUS}$ (as determined from the bus voltage feedback signal $V_{B\text{-}FB}$), i.e., $$e_{BUS}=V_{BUS}-V_{B\text{-}TARGET} \quad \text{(Equation 1)}$$

If the bus voltage error $e_{Bus}$ is greater than zero at step 312 (i.e., the magnitude of the bus voltage $V_{BUS}$ is greater than the target bus voltage $V_{B\text{-}TARGET}$), the microprocessor 160 decreases the on time $T_{ON}$ at step 314 by processing a digital implementation of a frequency-domain transfer function G(s), e.g., $$G(s)=\frac{K\cdot(s+a)}{s(s+b)}, \quad \text{(Equation 2)}$$

where a equals approximately 17, b equals approximately 96.7, and K equals approximately −258. Other values of a, b, and K may be needed based upon the voltage conversion ratios as well known in the art. If the bus voltage error $e_{Bus}$ is less than zero at step 316 (i.e., the magnitude of the bus voltage $V_{BUS}$ is less than the target bus voltage $V_{B\text{-}TARGET}$), the microprocessor 160 increases the on time $T_{ON}$ using a transfer function G(s) at step 318. If the on time $T_{ON}$ is greater than the maximum on time $T_{ON\text{-}MAX}$ at step 320, the microprocessor 160 limits the on time $T_{ON}$ to the maximum on time $T_{ON\text{-}MAX}$ at step 322, and the bus voltage control procedure 300 exits.

Figure 8:
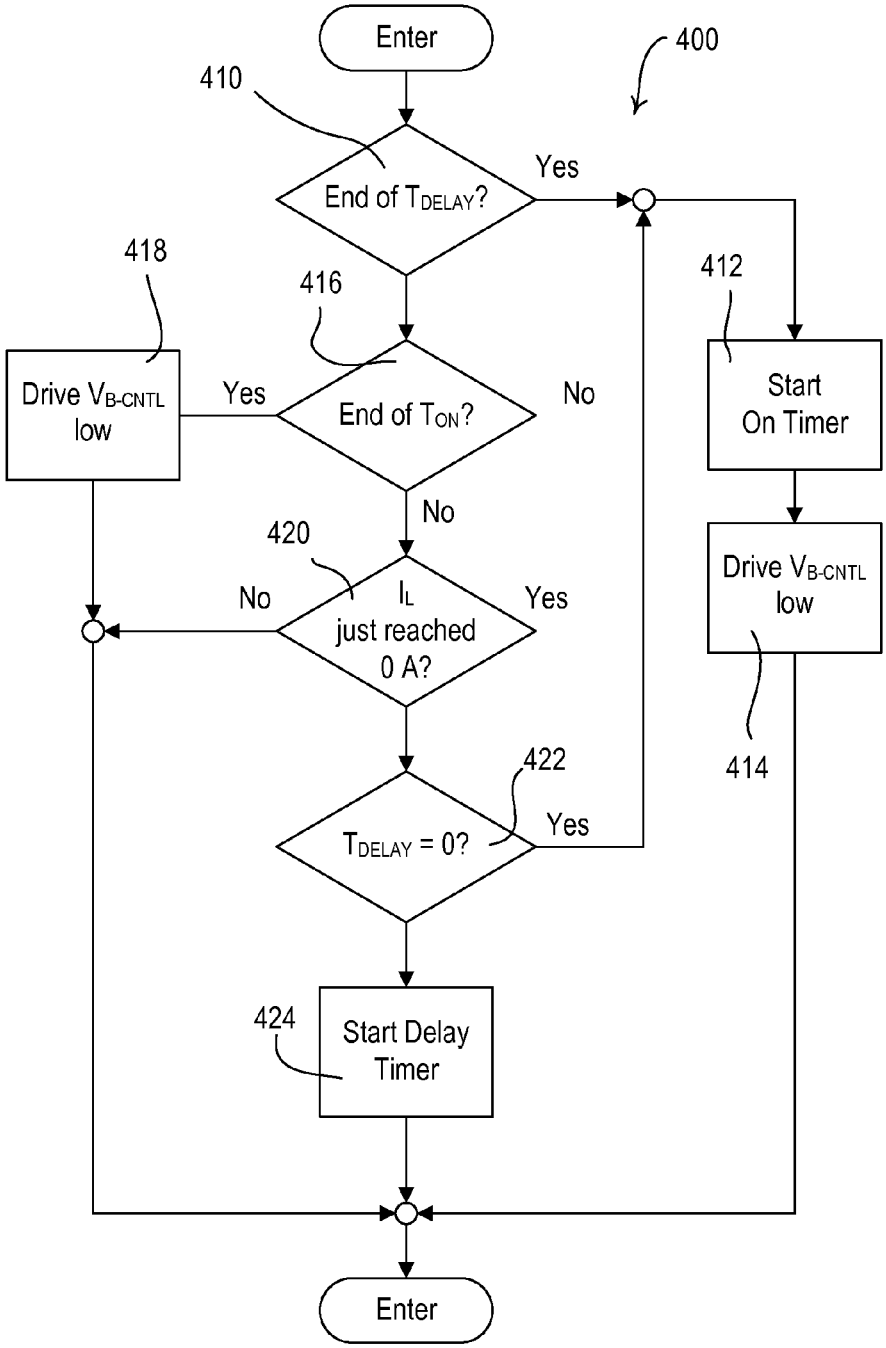
FIG. 8 is a simplified flowchart of a boost converter control procedure executed periodically by the microprocessor of the ballast of FIG. 1.

FIG. 8 is a simplified flowchart of a boost converter control procedure 400 executed periodically by the microprocessor 160 (e.g., approximately every 104 microseconds). The microprocessor 160 uses an on timer and a delay timer to keep track of the time periods of the inductor current $I_L$ and the bus voltage control signal $V_{B\text{-}CNTL}$ shown in FIGS. 3 and 4. If the delay timer has just expired at step 410 (i.e., at the end of the delay time $T_{DELAY}$), the microprocessor 160 initializes the on timer to the present value of the on time $T_{ON}$ (i.e., as determined from the bus voltage control procedure 300 of FIG. 7) and starts the on timer decreasing in value with respect to time at step 412. The microprocessor 160 then drives the bus voltage control signal $V_{B\text{-}CNTL}$ low towards circuit common at step 414 (such that the FET Q214 of the boost converter 130 is rendered conductive), and the boost converter control procedure 400 exits. Accordingly, the inductor current $I_L$ increases in magnitude with respect to time during the on time $T_{ON}$ as shown in FIGS. 3 and 4.

When the on timer expires at step 416 (i.e., at the end of the on time $T_{ON}$), the microprocessor 160 drives the bus voltage control signal $V_{B\text{-}CNTL}$ high towards the DC supply voltage $V_{CC}$ at step 418, such that the FET Q214 of the boost converter 130 is rendered non-conductive and the inductor current $I_L$ begins decreasing in magnitude with respect to time.

When the magnitude of the inductor current $I_L$ drops to zero amps (as determined from the zero-current feedback signal $V_{B\text{-}ZC}$ from the boost converter 130) at step 420, the microprocessor 160 determines if the delay time $T_{DELAY}$ is presently equal to zero seconds at step 422. If the delay time $T_{DELAY}$ is not equal to zero seconds at step 422, the microprocessor 160 initializes the delay timer with the present value of the delay time $T_{DELAY}$ (as determined from the bus voltage control procedure 300 of FIG. 7) and starts the delay timer decreasing in value with respect to time at step 424, before the boost converter control procedure 400 exits. The microprocessor 160 will render the FET Q214 of the boost converter 130 conductive at step 414 when the delay timer expires at step 410. If the delay time $T_{DELAY}$ is equal to zero seconds at step 422 when the magnitude of the inductor current $I_L$ drops to zero amps at step 420, the microprocessor 160 starts the on timer at step 412 and drives the bus voltage control signal $V_{B\text{-}CNTL}$ low towards circuit common at step 414 to render the FET Q214 conductive, before the boost converter control procedure 400 exits.

Figure 9:
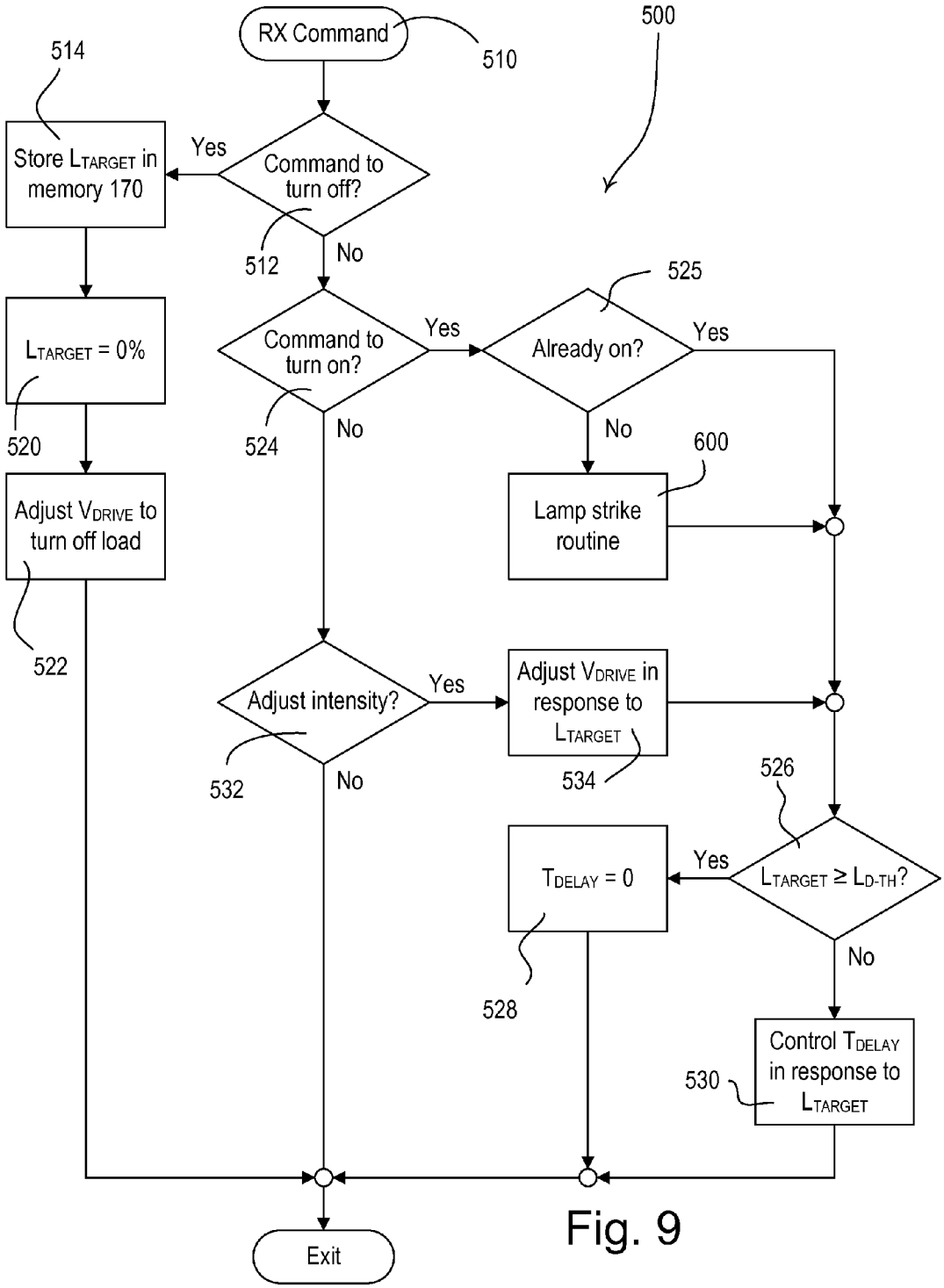
FIG. 9 is a simplified flowchart of a command procedure that is executed by the microprocessor of the ballast of FIG. 1 when a command to control the lamp is received.

FIG. 9 is a simplified flowchart of a command procedure 500 that is executed by the microprocessor 160 when a command to control the lamp 105 is received via the phase-control circuit 190 or the communication circuit 192 at step 510. If the received command is a command to turn the lamp 105 off at step 512, the microprocessor 160 first stores the present target intensity $L_{TARGET}$ of the lamp in the memory 170 at step 514, controls the target intensity $L_{TARGET}$ of the lamp 105 to 0% (i.e., to turn the lamp off) at step 520, and adjusts the drive control signal $V_{DRIVE}$ to the inverter circuit 150 to turn the lamp off at step 522, before the command procedure 500 exits.

If the microprocessor 160 has received a command to turn the lamp 105 on at step 524 and the lamp is not already on at step 525, the microprocessor executes a lamp strike routine 600 to attempt to strike the lamp (which will be described in greater detail below with reference to FIG. 10). If the lamp 105 is already on at step 525, the microprocessor 160 does not attempt to strike the lamp again as part of the lamp strike routine 600. The microprocessor 160 then adjusts the delay time $T_{DELAY}$ in response to the target intensity $L_{TARGET}$ of the lamp 105. Specifically, if the target intensity $L_{TARGET}$ is greater than or equal to the delay time threshold intensity $L_{D\text{-}TH}$ at step 526, the microprocessor 160 sets the delay time $T_{DELAY}$ equal to zero seconds at step 528, and the command procedure 500 exits. If the target intensity $L_{TARGET}$ is less than the delay time threshold intensity $L_{D\text{-}TH}$ at step 526, the microprocessor 160 adjusts the delay time $T_{DELAY}$ in response to the target intensity $L_{TARGET}$ at step 530 (e.g., as shown in FIG. 5), and the command procedure 500 exits. If the microprocessor 160 has received a command to adjust the target intensity $L_{TARGET}$ of the lamp 105 on at step 532, the microprocessor stores the new target intensity $L_{TARGET}$ (from the received command) in the memory 170, and adjusts the drive control signal $V_{DRIVE}$ to the inverter circuit 150 at step 534, so as to control the intensity of the lamp 105 to the target intensity $L_{TARGET}$ received with the command and controls the length of the delay time $T_{DELAY}$ at steps 526-530, before the command procedure 500 exits.

Figure 10:
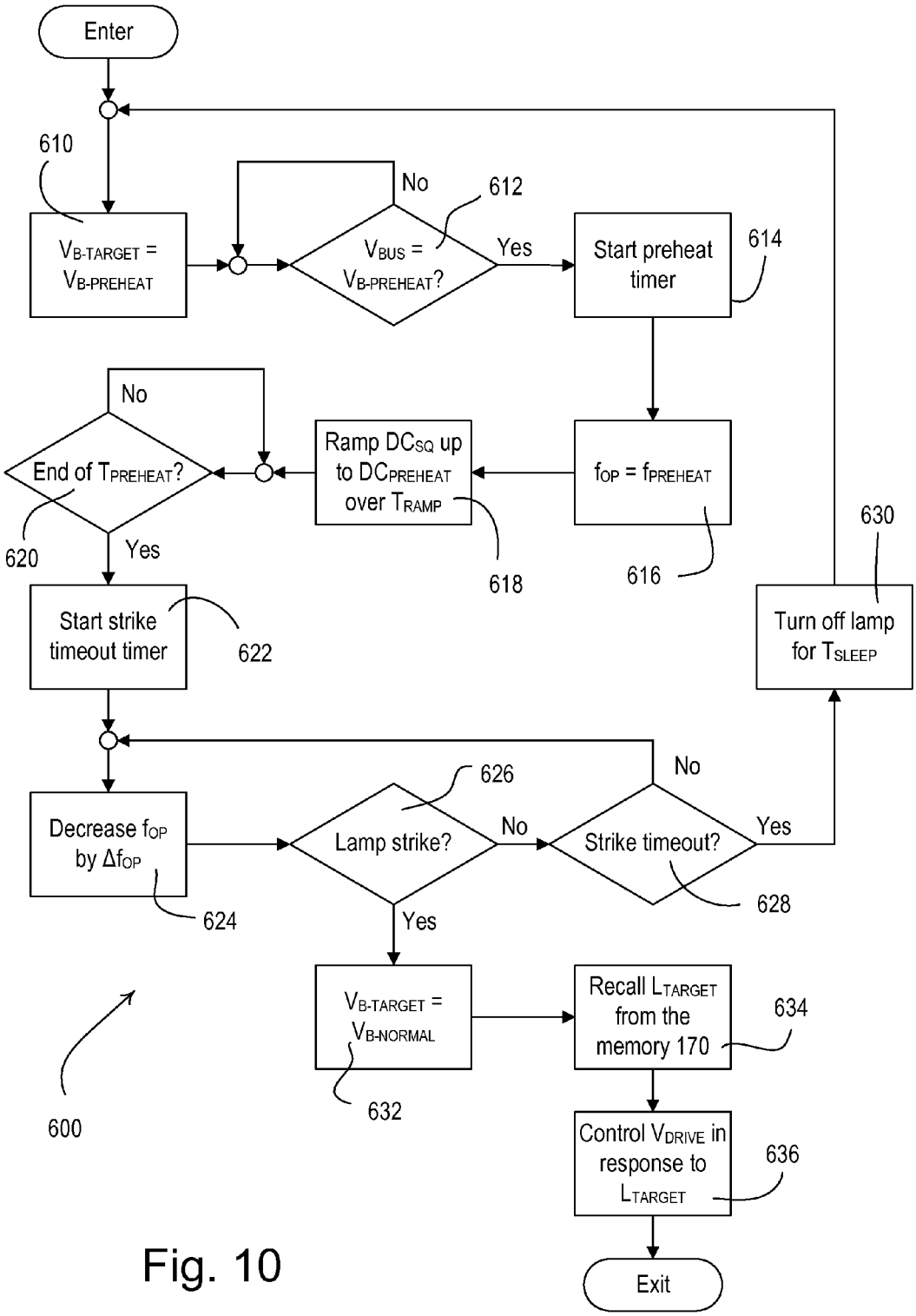

FIG. 10 is a simplified flowchart of the lamp strike routine 600 that is executed by the microprocessor 160 when the ballast 100 receives a command to turn the lamp 105 on at step 520 of the command procedure 500. The microprocessor 160 first controls the target bus voltage $V_{B\text{-}TARGET}$ to the preheat-bus-voltage magnitude $V_{B\text{-}PRE}$ at step 610, such that the microprocessor will begin adjusting the on time $T_{ON}$ (as part of the boost converter control procedure 400) to control the magnitude of the bus voltage $V_{BUS}$ up to the preheat-bus-voltage magnitude $V_{B\text{-}PRE}$. The microprocessor 160 then waits until the magnitude of the bus voltage $V_{BUS}$ is equal to approximately the preheat-bus-voltage magnitude $V_{B\text{-}PRE}$ (i.e., for the turn-on preload time period $T_{PRELOAD\text{-}ON}$) at step 612, before starting a preheat timer at step 614 and controlling the operating frequency $f_{OP}$ of the inverter circuit 150 to the preheat frequency $f_{PREHEAT}$ (i.e., approximately 130 kHz) at step 616. Alternatively, the microprocessor 160 could adjust the operating frequency $f_{OP}$ of the inverter circuit 150 in response to the magnitude of the load voltage feedback signal $V_{FB\text{-}VLOAD}$ while preheating the filaments of the lamp 105, so as to control the magnitude of the load voltage $V_{LOAD}$ to a predetermined preheat load voltage $V_{L\text{-}PRE}$ (as shown in FIG. 6). The microprocessor 160 ramps the operating duty cycle $DC_{OP}$ up from an initial duty cycle (e.g., approximately 0%) to a preheat duty cycle $DC_{PREHEAT}$ (e.g., approximately 50%) over a ramp time period $T_{RAMP}$ (e.g., approximately 50 milliseconds) at step 618, and then waits for the end of the preheat time period $T_{PREHEAT}$ at step 620.

After the end of the preheat time period $T_{PREHEAT}$ at step 620 (as determined from the preheat timer), the microprocessor 160 then attempts to strike the lamp 105. Specifically, the microprocessor 160 initializes a strike timeout period $T_{S\text{-}TO}$ to, for example, approximately 10 msec, and starts the strike timeout timer decreasing with respect to time at step 622, and controls the operating frequency $f_{OP}$ towards a strike target frequency (e.g., approximately 50 kHz) by decreasing the operating frequency $f_{OP}$ by a predetermined frequency value $M_{OP}$ (e.g., approximately 150 Hz) at step 624. In addition, the microprocessor 160 may also increase the duty cycle $DC_{OP}$ of the inverter circuit 150 towards a strike target duty cycle (e.g., approximately 35%) by a predetermined increment (e.g., approximately 1%) at step 624. The microprocessor 160 continues to decrease the operating frequency $f_{OP}$ by the predetermined frequency value $M_{OP}$ at step 624 until the lamp strikes at step 626 or the strike timeout timer expires at step 628. When the strike timeout timer expires at step 628, the microprocessor 160 waits for a sleep time period $T_{SLEEP}$ (e.g., approximately five seconds) at step 630 and then starts the lamp strike routine 600 over again to try to strike the lamp 105 once again. When the lamp 105 has been struck at step 626, the microprocessor 160 controls the target bus voltage $V_{B\text{-}TARGET}$ to the on-bus-voltage magnitude $V_{B\text{-}ON}$ at step 632, recalls the target intensity $L_{TARGET}$ from the memory 170 at step 634, and adjusts the drive control signal $V_{DRIVE}$ in response to the target intensity $L_{TARGET}$ at step 636, before the lamp strike routine 600 exits.

Figure 11:
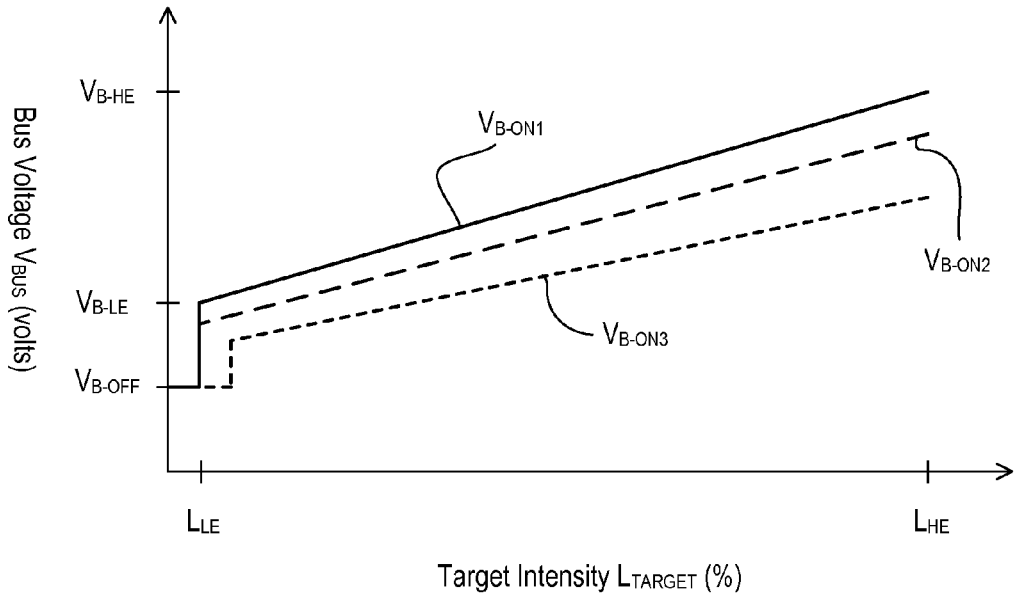
FIG. 11 is an example plot of the magnitude of a bus voltage with respect to a target intensity of a ballast according to a second embodiment of the present invention.

According to a second embodiment of the present invention, the microprocessor 160 may be operable to adjust the magnitude of the bus voltage $V_{BUS}$ as the target intensity $L_{TARGET}$ of the lamp 105 is dimmed between the low-end intensity $L_{LE}$ and the high-end intensity $L_{MAX}$. FIG. 11 is an example plot of the magnitude of the bus voltage $V_{BUS}$ (i.e., a variable on-bus-voltage magnitude $V_{B\text{-}ON1}$) with respect to the target intensity $L_{TARGET}$ of the lamp 105 according to the second embodiment when the magnitude of the AC mains line voltage $V_{AC}$ is nominally 120 VAC. The magnitude of the bus voltage $V_{BUS}$ may be controlled to a high-end bus voltage magnitude $V_{B\text{-}HE}$ (e.g., approximately 465 volts) when the target intensity $L_{TARGET}$ is at the high-end intensity $L_{HE}$ and decreased linearly to a low-end bus voltage magnitude $V_{B\text{-}LE}$ (e.g., approximately 310 volts) when the target intensity $L_{TARGET}$ is at the low-end intensity $L_{LE}$ (as shown by the variable on-bus-voltage magnitude $V_{B\text{-}ON1}$ in FIG. 11). The magnitude of the bus voltage is controlled to the off-bus-voltage magnitude $V_{B\text{-}OFF}$ (i.e., approximately 205 volts) when the lamp 105 is off (i.e., below the low-end intensity $L_{LE}$). In addition, the magnitude of the bus voltage $V_{BUS}$ may be controlled to different values in response to the type of lamp 105 connected to the ballast 100 as shown by second and third variable on-bus-voltage magnitudes $V_{B\text{-}ON2}$, $V_{B\text{-}ON3}$ in FIG. 11.

Figure 12:
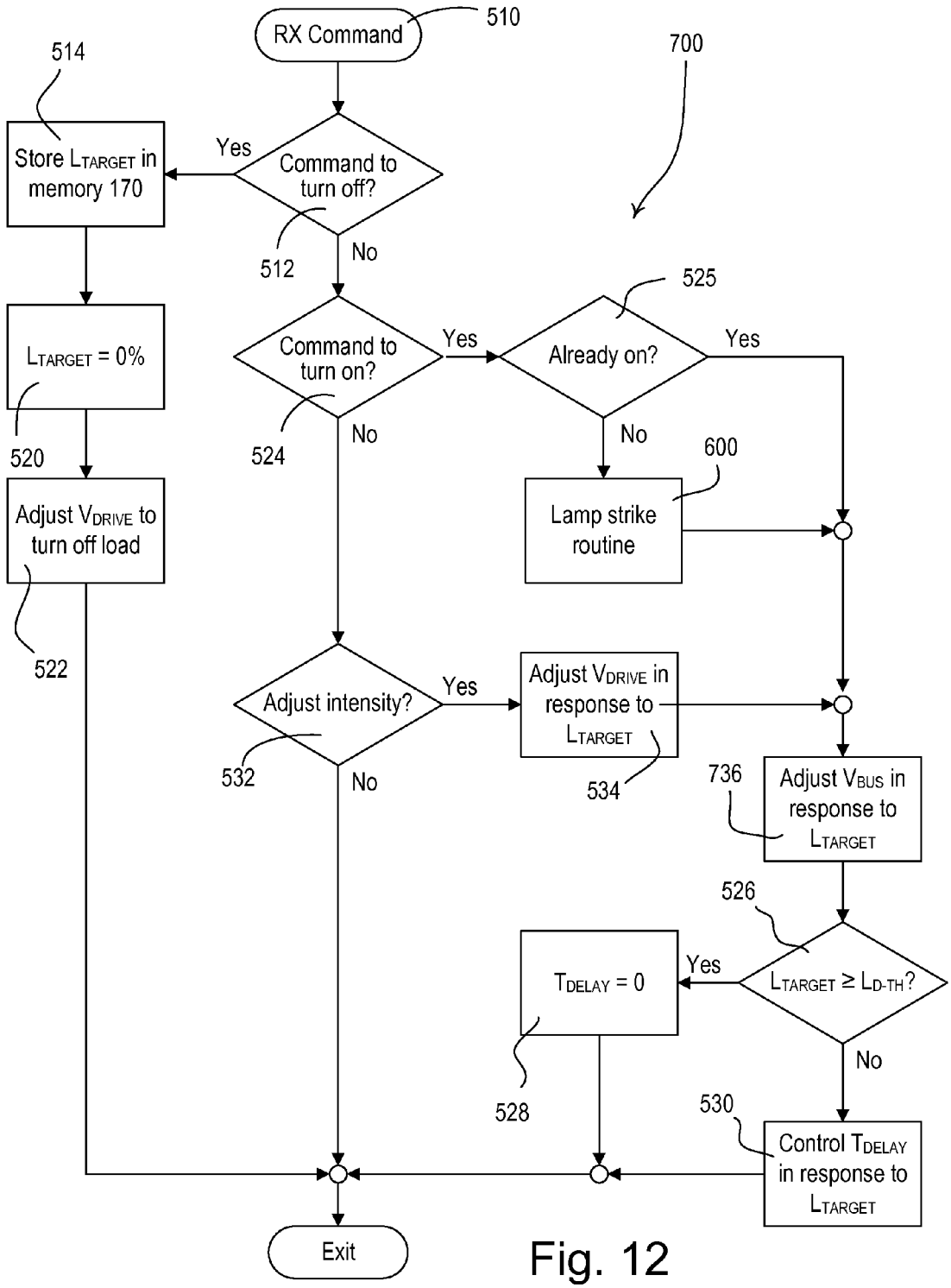
FIG. 12 is a simplified flowchart of a command procedure according to the second embodiment of the present invention.

FIG. 12 is a simplified flowchart of a command procedure 700 executed by the microprocessor 160 when a command to control the lamp 105 is received according to the second embodiment of the present invention. The command procedure 700 of the second embodiment is very similar to the command procedure 500 of the first embodiment (as shown in FIG. 9). However, after the lamp 105 is turned on at step 524 or the target intensity $L_{TARGET}$ is adjusted at step 532, the microprocessor 160 adjusts the power-conversion-drive level of the boost converter 130 (i.e., the on time $T_{ON}$) at step 736, so as to control the magnitude of the bus voltage $V_{BUS}$ in response to the target intensity $L_{TARGET}$ of the lamp 105, before the command procedure 700 exits. The microprocessor 160 may control the magnitude of the bus voltage $V_{BUS}$ at step 736 in response to the target intensity $L_{TARGET}$ according to a predetermined relationship, e.g., according to the first variable on-bus-voltage magnitude $V_{B\text{-}ON1}$ shown in FIG. 11.

Figure 13:
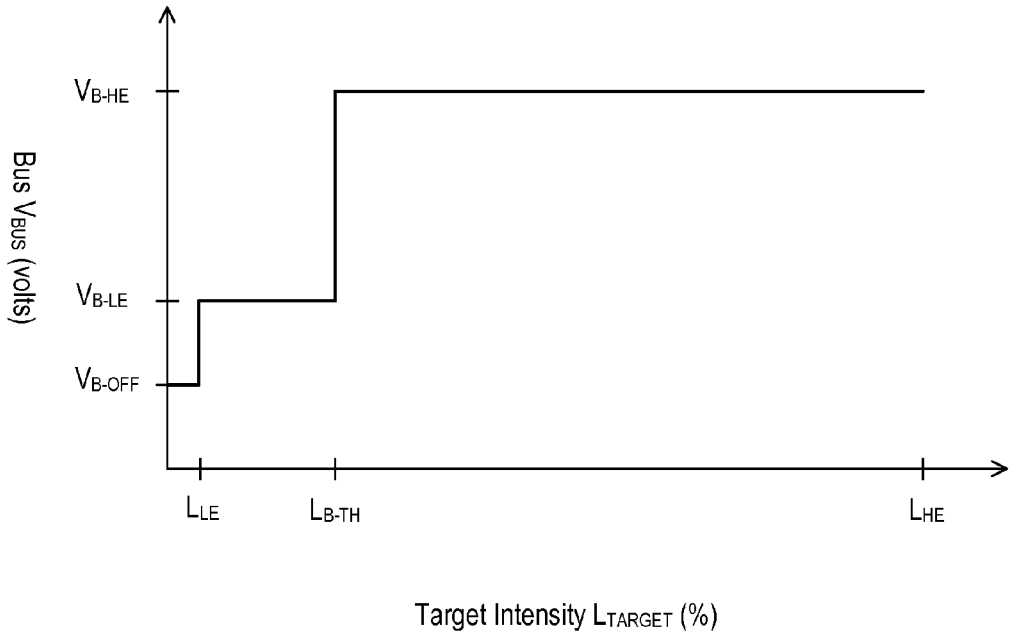
FIG. 13 is an example plot of the magnitude of the bus voltage with respect to the target intensity of a ballast according to a third embodiment of the present invention.

According to a third embodiment of the present invention, the microprocessor 160 may be operable to control the magnitude of the bus voltage $V_{BUS}$ to two different discrete magnitudes in response to the target intensity $L_{TARGET}$ when the lamp 105 is on. FIG. 13 is an example plot of the magnitude of the bus voltage $V_{BUS}$ with respect to the target intensity $L_{TARGET}$ of the lamp 105 according to the third embodiment when the magnitude of the AC mains line voltage $V_{AC}$ is 120 VAC. When the target intensity $L_{TARGET}$ is greater than or equal to a bus voltage threshold intensity $L_{B\text{-}TH}$ (e.g., approximately 30%), the magnitude of the bus voltage $V_{BUS}$ is controlled to the high-end bus voltage magnitude $V_{B\text{-}HE}$ (i.e., approximately 465 volts). When the target intensity $L_{TARGET}$ is less than the threshold intensity $L_{TH}$, the magnitude of the bus voltage $V_{BUS}$ is controlled to the low-end bus voltage magnitude $V_{B\text{-}LE}$ (i.e., approximately 50-100 volts). In addition, the magnitude of the bus voltage is controlled to the off-bus-voltage magnitude $V_{B\text{-}OFF}$ (i.e., approximately 205 volts) when the lamp 105 is off (i.e., below the low-end intensity $L_{LE}$).

Figure 14:
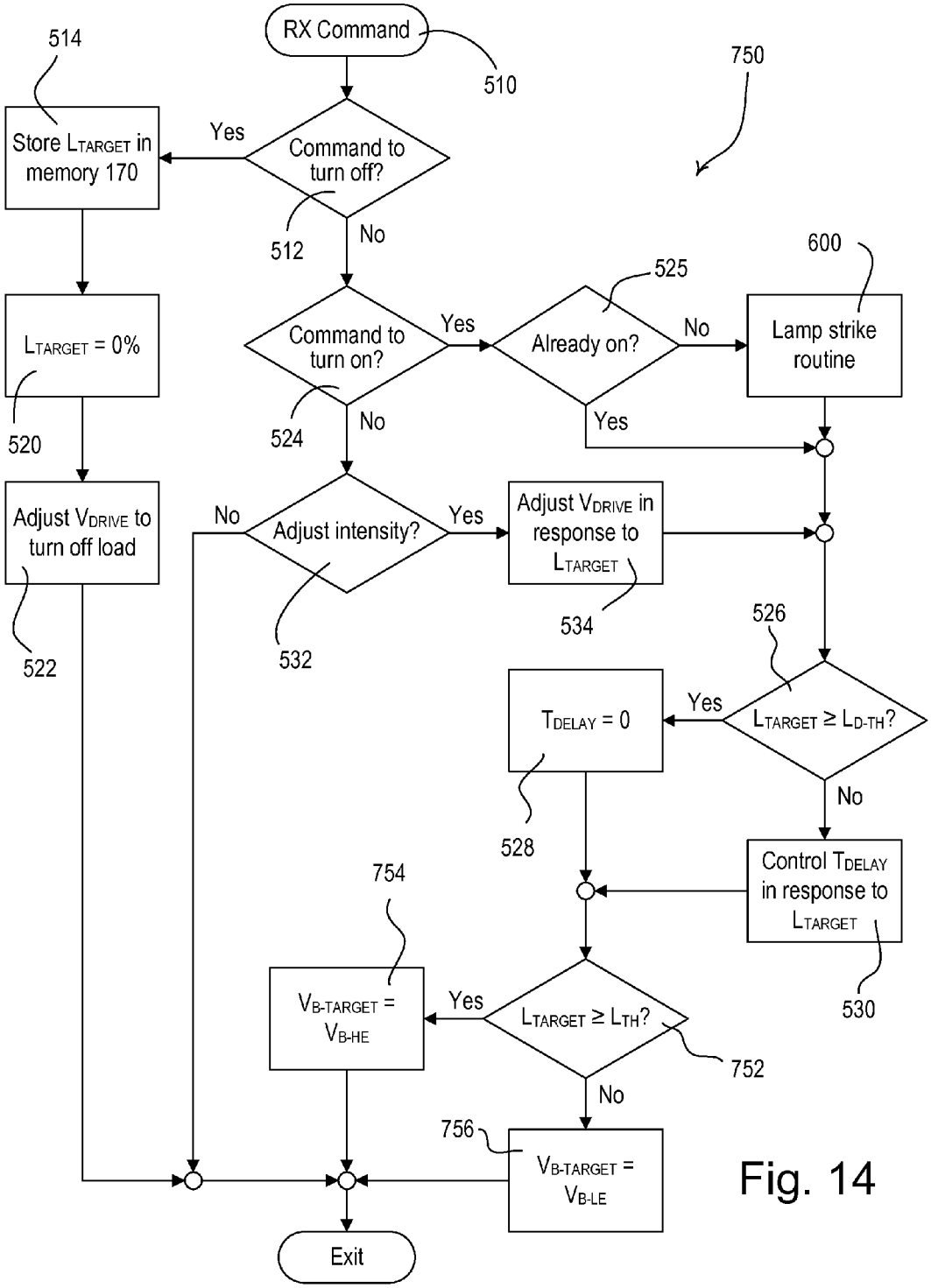
FIG. 14 is a simplified flowchart of a command procedure according to the third embodiment of the present invention.

FIG. 14 is a simplified flowchart of a command procedure 750 executed by the microprocessor 160 when a command to control the lamp 105 is received according to the third embodiment of the present invention. The command procedure 750 of the third embodiment is also very similar to the command procedure 500 of the first embodiment (as shown in FIG. 9). However, after the lamp 105 is turned on at step 524 or the target intensity $L_{TARGET}$ is adjusted at step 532, the microprocessor 160 controls the target bus voltage $V_{B\text{-}TARGET}$ in response to the target intensity $L_{TARGET}$ of the lamp 105. Specifically, if the target intensity $L_{TARGET}$ is greater than or equal to the threshold intensity $L_{TH}$ at step 752, the microprocessor 160 sets the target bus voltage $V_{B\text{-}TARGET}$ equal to the high-end bus voltage magnitude $V_{B\text{-}HE}$ at step 754, and the command procedure 750 exits. If the target intensity $L_{TARGET}$ is less than the threshold intensity $L_{TH}$ at step 752, the microprocessor 160 sets the target bus voltage $V_{B\text{-}TARGET}$ equal to the low-end bus voltage magnitude $V_{B\text{-}LE}$ at step 756, and the command procedure 750 exits.

Figure 15:
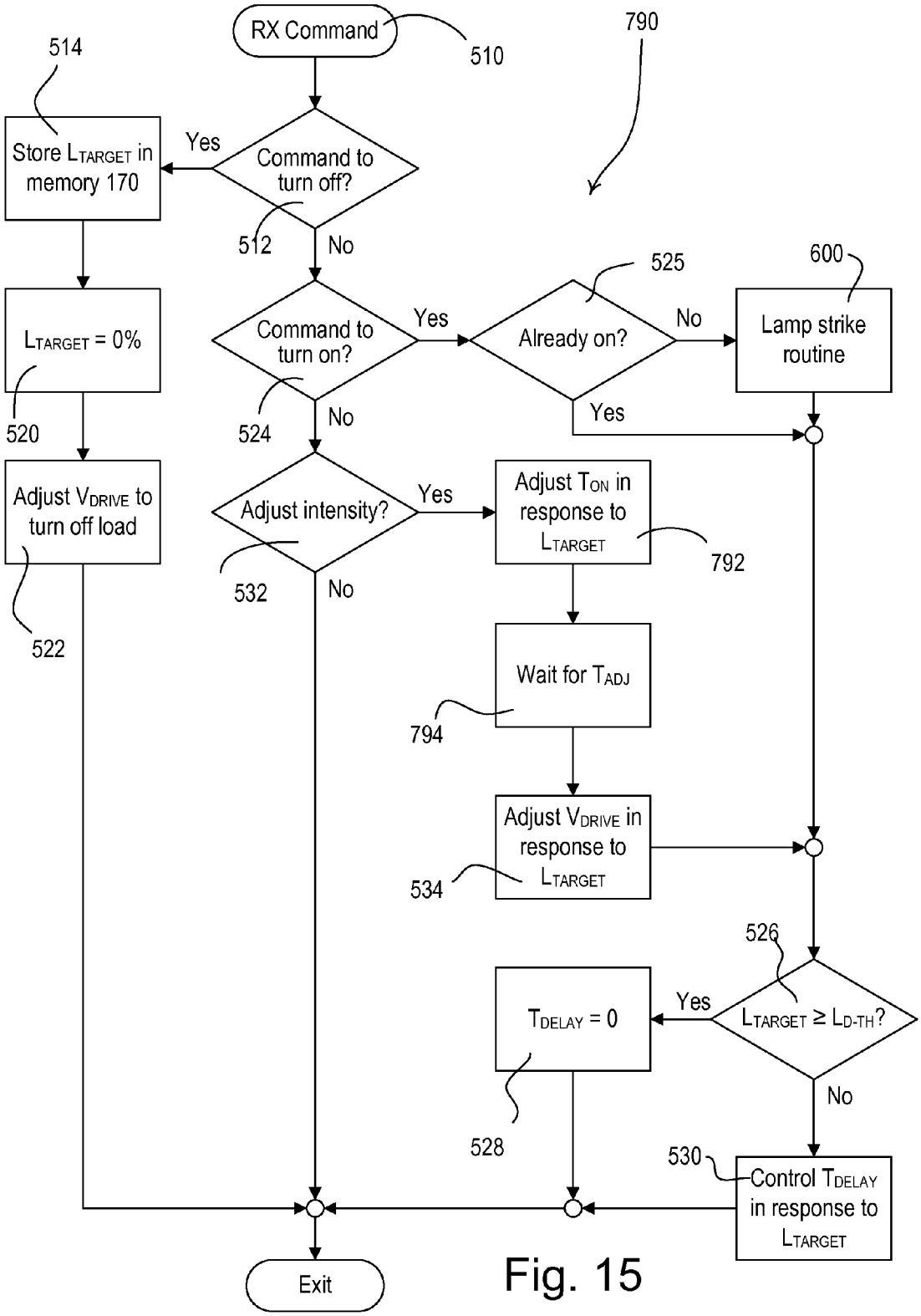
FIG. 15 is a simplified block diagram of a light-emitting diode (LED) driver for controlling the intensity of an LED light source according to a fourth embodiment of the present invention.

FIG. 15 is a simplified block diagram of a light-emitting diode (LED) driver 800 for controlling the intensity of an LED light source 805 (e.g., an LED light engine) according to a fourth embodiment of the present invention. The LED driver 800 includes many similar functional blocks as the electronic dimming ballast 100 of the first embodiment (as shown in FIG. 1). However, the LED driver 800 includes a load control circuit 840 comprising an LED drive circuit 850, which receives the bus voltage $V_{BUS}$ and controls the amount of power delivered to the LED light source 805 so as to control the intensity of the LED light source. The LED drive circuit 850 may comprise, for example, a controllable-impedance circuit (such as a linear regulator) or a switching regulator (such as a buck converter). A control circuit, e.g., a microprocessor 860 provides the drive control signal $V_{DRIVE}$ to the LED drive circuit 850 for controlling at least one of the magnitude of a load current $I_{LOAD}$ conducted through the LED light source 805 and the magnitude of a load voltage $V_{LOAD}$ produced across the LED light source, so as to adjust the intensity of the LED light source. Examples of LED drivers are described in greater detail in commonly-assigned U.S. patent application Ser. No. 12/813,908, filed Jun. 11, 2010, entitled LOAD CONTROL DEVICE FOR A LIGHT-EMITTING DIODE LIGHT SOURCE, the entire disclosure of which is hereby incorporated by reference.

The LED driver 800 also includes a power converter 830, which may comprise the boost converter 130 of the first embodiment. The microprocessor 860 is coupled to the power converter 830 for adjusting the magnitude of the bus voltage $V_{BUS}$ using the bus voltage control procedure 300 (shown in FIG. 7) and the boost converter control procedure 400 (shown in FIG. 8). Alternatively, the power converter 830 may comprise, for example, a buck converter, a buck-boost converter, a flyback converter, a buck-boost flyback converter, a single-ended primary-inductor converter (SEPIC), a Ćuk converter, or other suitable power converter circuit.

The microprocessor 860 is operable to control the magnitude of the bus voltage $V_{BUS}$ to the on-bus-voltage magnitude $V_{B\text{-}ON}$ when the LED light source 805 is on and to the off-bus-voltage magnitude $V_{B\text{-}OFF}$ when the LED light source is off. In addition, the microprocessor 860 preemptively adjusts the power-conversion-drive level of the power converter 830 prior to changing modes of operation. Specifically, the microprocessor 860 adjusts the target bus voltage $V_{B\text{-}TARGET}$ to the on-bus-voltage magnitude $V_{B\text{-}ON}$, and then waits for the turn-on preload time period $T_{PRELOAD\text{-}ON}$ before turning on the LED light source 805. The microprocessor 860 is further operable to adjust the target bus voltage $V_{B\text{-}TARGET}$ to the off-bus-voltage magnitude $V_{B\text{-}OFF}$, and then wait for a turn-off preload time period $T_{PRELOAD\text{-}OFF}$, before turning off the LED light source 805. Further, the microprocessor 860 may be operable to determine that the LED light source 805 has been removed (i.e., decoupled from the LED drive circuit 850) or has filed while the LED driver 800 is energized and running in response to detecting a large, instantaneous drop in the magnitude of the load current $I_{LOAD}$. The microprocessor 860 may then be operable adjust the magnitude of the bus voltage $V_{BUS}$ to the off-bus-voltage magnitude $V_{B\text{-}OFF}$, and wait for the turn-off preload time period $T_{PRELOAD\text{-}OFF}$, before turning off the LED light source 805. In addition, the LED driver 800 may be operable to control the magnitude of the bus voltage $V_{BUS}$ in response to a rated operating voltage of the LED light source 805, or in response to a voltage developed across the LED drive circuit 850 in order to optimize the amount of power consumed in the LED driver 800 as described in the previously-referenced application Ser. No. 12/813,908.

Figure 16:
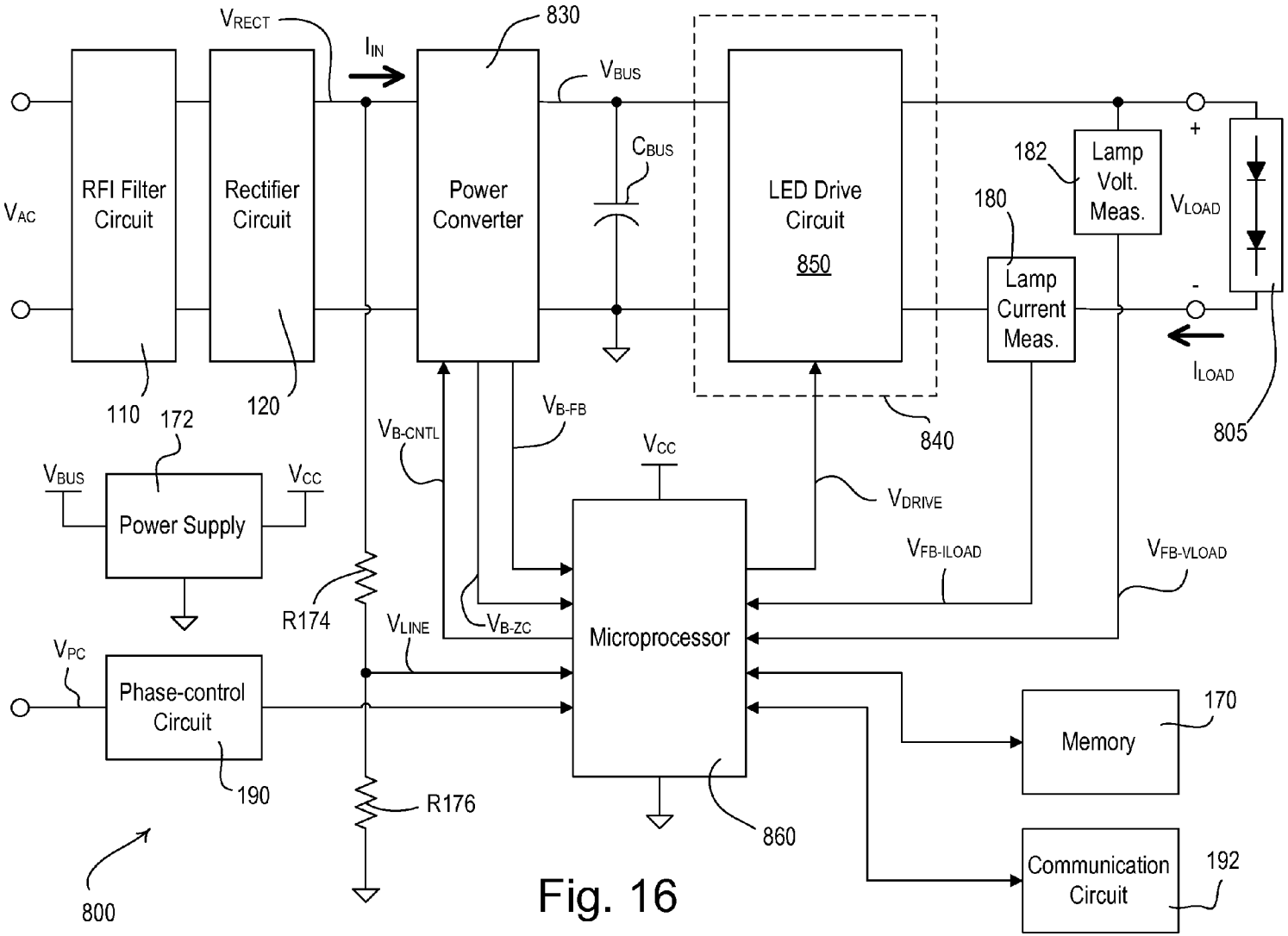
FIG. 16 is a simplified flowchart of a command procedure executed by a microprocessor of the LED driver of FIG. 15 when a command to control the LED light source is received.

FIG. 16 is a simplified flowchart of a command procedure 900 executed by the microprocessor 860 according to the fourth embodiment of the present invention when a command to control the LED light source 805 is received by the LED driver 800. The command procedure 900 of the fourth embodiment is very similar to the command procedure 500 of the first embodiment (as shown in FIG. 9). However, when the LED light source 805 is turned on at step 524, the microprocessor 860 controls the target bus voltage $V_{B\text{-}TARGET}$ to the on-bus-voltage magnitude $V_{B\text{-}ON}$ at step 950, such that the microprocessor will begin adjusting the power-conversion-drive level of the power converter 830 (i.e., the on time $T_{ON}$) to control the magnitude of the bus voltage $V_{BUS}$ up to the on-bus-voltage magnitude $V_{B\text{-}ON}$. The microprocessor 860 waits for the turn-on preload time period $T_{PRELOAD\text{-}ON}$ at step 952 and adjusts the drive control signal $V_{DRIVE}$ to the LED drive circuit 850 at step 954 to control the intensity of the LED light source 805 to the target intensity $L_{TARGET}$ (e.g., as received with the command or as stored in the memory 170), before the command procedure 900 exits.

In addition, when the LED lighting source 805 is turned off at step 512, the microprocessor 860 controls the target bus voltage $V_{B\text{-}TARGET}$ to the off-bus-voltage magnitude $V_{B\text{-}OFF}$ at step 960, to begin adjusting the power-conversion-drive level of the boost converter 130 (i.e., the on time $T_{ON}$), so as to bring the magnitude of the bus voltage $V_{BUS}$ down to the off-bus-voltage magnitude $V_{B\text{-}OFF}$. The microprocessor 860 then waits for the turn-off preload time period $T_{PRELOAD\text{-}OFF}$ at step 962, before controlling the target intensity $L_{TARGET}$ to 0% (i.e., turning the LED light source 805 off) at step 520, and adjusting the drive control signal $V_{DRIVE}$ to the inverter circuit 150 to turn the lamp off at step 522.

Alternatively, the hot terminal H of the ballast 100 of the first, second, and third embodiments and the LED driver 800 of the fourth embodiment could be adapted to receive the phase-control signal $V_{PC}$ rather than the full AC mains line voltage $V_{AC}$, such that the ballast and the LED driver are operable to both receive power and determine the target intensity $L_{TARGET}$ from the phase-control signal $V_{PC}$. An example of a load control device that receives both power and control information from a single terminal is described in greater detail in commonly-assigned U.S. patent application Ser. No. 12/704,781, filed Feb. 12, 2010, entitled HYBRID LIGHT SOURCE, the entire disclosure of which is hereby incorporated by reference.

While the present invention has been described with reference to the ballast 100 and the LED driver 800, the methods of controlling the magnitude of the bus voltage $V_{BUS}$ of a power converter described herein may be used in other types of load control devices, such as, for example, a dimmer switch for a lighting load, an electronic switch, a switching circuit including a relay, a controllable plug-in module adapted to be plugged into an electrical receptacle, a controllable screw-in module adapted to be screwed into the electrical socket (e.g., an Edison socket) of a lamp, a motor speed control device, or a motorized window treatment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a gas discharge lamp, the ballast comprising:

a power converter for generating a DC bus voltage;

an inverter circuit for converting the bus voltage to a high-frequency AC voltage;

a resonant tank operable to couple the high-frequency AC voltage to the lamp to generate a load current through the lamp;

a control circuit coupled to the inverter circuit for controlling the magnitude of the load current through the lamp, the control circuit further coupled to the power converter for adjusting the magnitude of the bus voltage to a first magnitude when the lamp is off, to a second magnitude when preheating filaments of the lamp, and to a third magnitude when the lamp is on;

wherein the second magnitude is greater than the first and third magnitudes.

2. The electronic ballast of claim 1, wherein the control circuit is operable to preheat filaments of the lamp by adjusting an operating frequency of the inverter circuit to a preheat frequency, the control circuit further operable to adjust the magnitude of the bus voltage to the second magnitude when the operating frequency of the inverter circuit is being controlled to the preheat frequency.

3. The electronic ballast of claim 2, wherein the power converter comprises a boost converter.

4. The electronic ballast of claim 3, wherein the control circuit adjusts a power-conversion-drive level of the boost converter to begin adjusting the magnitude of the bus voltage towards the second magnitude.

5. The electronic ballast of claim 4, wherein the power converter comprises a power switching device that is controlled to be conductive and non-conductive in response to a control signal.

6. The electronic ballast of claim 5, wherein the power-conversion-drive level is a duty cycle of the control signal that controls the power switching device of the power converter.

7. The electronic ballast of claim 4, wherein the control circuit waits for a predetermined time period after adjusting the power-conversion-drive level before preheating filaments of the lamp and attempting to strike the lamp.

8. The electronic ballast of claim 4, wherein the control circuit waits until the magnitude of the bus voltage is approximately equal to the second magnitude before preheating filaments of the lamp and attempting to strike the lamp.

9. The electronic ballast of claim 3, further comprising:

a rectifier circuit operable to receive an AC line voltage from the AC power source and to generate a rectified voltage having a peak magnitude;

wherein the boost converter receives the rectified voltage and generates the DC bus voltage, such that the magnitude of the bus voltage is greater than the peak magnitude of the rectified voltage.

10. The electronic ballast of claim 1, wherein the control circuit is operable to control the inverter circuit to adjust the magnitude of the load current through the lamp, so as to control the intensity of the lamp to a target intensity between a low-end intensity and a high-end intensity, the control circuit further operable to adjust the magnitude of the bus voltage in response to the target intensity of the lamp.

11. The electronic ballast of claim 10, wherein the control circuit is operable to decrease the magnitude of the bus voltage when the target intensity of the lamp is at or near the low-end intensity.

12. The electronic ballast of claim 11, wherein the control circuit is operable to decrease the magnitude of the bus voltage linearly as the target intensity decreases.

13. The electronic ballast of claim 11, wherein the control circuit is operable to control the magnitude of the bus voltage to a high-end bus voltage magnitude when the target intensity is above a threshold intensity and to a low-end bus voltage magnitude when the target intensity is below the threshold intensity.

14. The electronic ballast of claim 1, wherein the first magnitude is greater than approximately zero volts.

15. An electronic ballast for driving a gas discharge lamp, the ballast comprising:

a power converter for generating a DC bus voltage;

an inverter circuit for converting the bus voltage to a high-frequency AC voltage having an operating frequency;

a resonant tank operable to couple the high-frequency AC voltage to the lamp to generate a load current through the lamp; and a control circuit coupled to the inverter circuit for controlling the magnitude of the load current through the lamp and to the power converter for adjusting the magnitude of the bus voltage;

wherein, prior to preheating filaments of the lamp, the control circuit is operable to control a power-conversion-drive level of the power converter to begin adjusting the magnitude of the bus voltage towards a first predetermined magnitude, and to wait for a first predetermined time period after controlling the power-conversion-drive level before adjusting the operating frequency of the inverter circuit to a preheat frequency.

16. The electronic ballast of claim 15, wherein the control circuit waits until the magnitude of the bus voltage is approximately equal to the first predetermined magnitude before adjusting the operating frequency of the inverter circuit to a preheat frequency.

17. The electronic ballast of claim 16, wherein the control circuit is operable to maintain the magnitude of the bus voltage at the first predetermined magnitude when the operating frequency of the inverter circuit is being controlled to the preheat frequency.

18. The electronic ballast of claim 16, wherein the control circuit adjusts the operating frequency of the inverter circuit to control the magnitude of a load voltage across the lamp to a predetermined preheat load voltage, the control circuit further operable to maintain the magnitude of the bus voltage at the first predetermined magnitude when the operating frequency of the inverter circuit is being controlled to preheat the filaments of the lamp.

19. The electronic ballast of claim 15, wherein the power converter comprises a power switching device that is controlled to be conductive and conductive in response to a control signal.

20. The electronic ballast of claim 19, wherein the power-conversion-drive level is a duty cycle of the control signal that controls the power switching device of the power converter.

21. The electronic ballast of claim 15, wherein the control circuit adjusts the power-conversion-drive level of the power converter so as to increase the magnitude of the bus voltage before attempting to turn the load on.

* * * * *